US011090571B2

(12) United States Patent
Hunter et al.

(10) Patent No.: US 11,090,571 B2
(45) Date of Patent: Aug. 17, 2021

(54) AMUSEMENT ATTRACTION FLUID CONTROL SYSTEM

(71) Applicant: PROSLIDE TECHNOLOGY INC., Ottawa (CA)

(72) Inventors: Richard D. Hunter, Ottawa (CA); Raymond T. Smegal, Ottawa (CA)

(73) Assignee: ProSlide Technology Inc., Ottawa (CA)

( * ) Notice: Subject to any disclaimer, the term of this patent is extended or adjusted under 35 U.S.C. 154(b) by 0 days.

(21) Appl. No.: 15/305,859

(22) PCT Filed: Apr. 23, 2015

(86) PCT No.: PCT/CA2015/050339
§ 371 (c)(1),
(2) Date: Oct. 21, 2016

(87) PCT Pub. No.: WO2015/161382
PCT Pub. Date: Oct. 29, 2015

(65) Prior Publication Data

US 2017/0043264 A1 Feb. 16, 2017

Related U.S. Application Data

(60) Provisional application No. 61/983,251, filed on Apr. 23, 2014.

(51) Int. Cl.
*A63G 21/12* (2006.01)
*A63G 21/18* (2006.01)

(52) U.S. Cl.
CPC ..... *A63G 21/12* (2013.01); *A63G 21/18* (2013.01)

(58) Field of Classification Search
CPC ... A63G 3/00; A63G 3/02; A63G 3/04; A63G 3/06; A63G 21/00; A63G 21/18; A63G 33/00
(Continued)

(56) References Cited

U.S. PATENT DOCUMENTS 2,604,055 A 7/1949 Snowden
3,000,022 A 9/1961 Cathey et al.
(Continued)

FOREIGN PATENT DOCUMENTS

CA 2654714 A1 3/2002
CA 2674329 1/2011
(Continued)

OTHER PUBLICATIONS

Extended European Search Report, pursuant to Rule 62 EPC, from the European Patent Office, issued in Application No. 16192350.3-1658, dated Mar. 28, 2017. 8 pages.
(Continued)

*Primary Examiner* — Kien T Nguyen
(74) *Attorney, Agent, or Firm* — Finnegan, Henderson, Farabow, Garrett & Dunner, L.L.P.

(57) ABSTRACT

An amusement attraction fluid control system comprises a fluid source, at least one pump, at least one fluid feature, a plurality of conduits interconnecting the fluid source and the at least one pump to the at least one fluid feature, and a controller; wherein the at least one pump is configured to pump fluid through the conduits to the at least one fluid feature. The controller is adapted to control the at least one pump to deliver fluid to each respective fluid feature.

14 Claims, 20 Drawing Sheets

(58) Field of Classification Search
USPC ..... 472/117, 128–129; 104/69–70
See application file for complete search history.

(56) References Cited

U.S. PATENT DOCUMENTS

| | | | | |
|---|---|---|---|---|
| 3,438,074 | A | 4/1969 | Goyen | |
| 5,031,556 | A | 6/1991 | Blee | |
| 5,213,547 | A * | 5/1993 | Lochtefeld | A63G 3/00 104/70 |
| 5,219,315 | A | 6/1993 | Fuller et al. | |
| 5,230,662 | A | 7/1993 | Langford | |
| 5,503,597 | A * | 4/1996 | Lochtefeld | A63G 3/02 4/904 |
| 5,527,646 | A | 6/1996 | Ogino et al. | |
| 5,716,282 | A | 2/1998 | Ring et al. | |
| 5,738,590 | A | 4/1998 | Lochtefeld | |
| 6,006,672 | A | 12/1999 | Newfarmer et al. | |
| 6,435,927 | B1 | 8/2002 | Fireman | |
| 6,527,646 | B1 * | 3/2003 | Briggs | A63G 33/00 104/69 |
| 6,561,914 | B2 | 5/2003 | Henry | |
| 6,702,687 | B1 | 3/2004 | Henry | |
| 6,743,108 | B2 | 6/2004 | Hunter | |
| 6,758,231 | B1 * | 7/2004 | Lochtefeld | A63G 3/00 104/70 |
| 7,229,359 | B2 | 6/2007 | Henry | |
| 7,285,053 | B2 | 10/2007 | Henry et al. | |
| 7,497,784 | B2 | 3/2009 | Henry | |
| 7,727,077 | B2 | 6/2010 | Henry et al. | |
| 7,731,595 | B2 | 6/2010 | Hlynka | |
| 7,740,542 | B2 | 6/2010 | Henry et al. | |
| 7,758,435 | B2 | 7/2010 | Henry et al. | |
| 7,758,535 | B2 | 7/2010 | Levine et al. | |
| 7,762,900 | B2 | 7/2010 | Henry et al. | |
| 7,766,753 | B2 * | 8/2010 | Henry | A63G 3/00 472/128 |
| 7,785,207 | B2 | 8/2010 | Henry et al. | |
| 7,896,752 | B2 | 3/2011 | Yule | |
| 7,942,752 | B2 | 5/2011 | Henry | |
| 8,070,616 | B2 * | 12/2011 | Dubois | A63G 21/18 472/117 |
| 8,075,413 | B2 | 12/2011 | Henry et al. | |
| 8,079,916 | B2 * | 12/2011 | Henry | A63G 3/02 472/117 |
| 8,197,353 | B2 | 6/2012 | Brassard | |
| 8,210,954 | B2 | 7/2012 | Henry et al. | |
| 8,282,497 | B2 | 10/2012 | Henry et al. | |
| 8,453,579 | B2 | 6/2013 | Nemeth | |
| 8,579,715 | B2 | 11/2013 | Olive et al. | |
| 9,220,989 | B2 | 12/2015 | Fisher | |
| 2002/0082097 | A1 | 6/2002 | Henry | |
| 2003/0069078 | A1 | 4/2003 | Aragona et al. | |
| 2005/0034768 | A1 | 2/2005 | Lochtefeld et al. | |
| 2007/0060403 | A1 | 3/2007 | Henry | |
| 2010/0160054 | A1 | 6/2010 | Henry | |
| 2011/0028227 | A1 | 2/2011 | Dubois et al. | |
| 2012/0201605 | A1 | 9/2012 | Hill | |
| 2012/0258812 | A1 | 10/2012 | Osterman et al. | |
| 2013/0184087 | A1 | 7/2013 | Degirmenci | |
| 2014/0171211 | A1 | 6/2014 | Fisher | |
| 2016/0136527 | A1 | 5/2016 | Hunter | |
| 2017/0043264 | A1 | 2/2017 | Hunter et al. | |

FOREIGN PATENT DOCUMENTS

| | | | |
|---|---|---|---|
| CA | 2888630 | A1 | 4/2014 |
| CN | 2 905 159 | Y | 5/2007 |
| CN | 2905159 | Y | 5/2007 |
| CN | 101 417 179 | A | 4/2009 |
| CN | 104797312 | A | 7/2015 |
| EP | 0601641 | A1 | 6/1994 |
| JP | H-03258280 | | 11/1991 |
| JP | 10-216363 | | 8/1998 |
| RU | 68338 | U1 | 11/2007 |
| WO | WO 88/05745 | A1 | 8/1988 |
| WO | WO 9204087 | A1 | 3/1992 |
| WO | WO 2007/027841 | A2 | 3/2007 |
| WO | WO 2012/048016 | A2 | 4/2012 |
| WO | WO 2013/000090 | A1 | 1/2013 |
| WO | WO 2014/059551 | A1 | 4/2014 |
| WO | WO 2015/161382 | A1 | 10/2015 |

OTHER PUBLICATIONS

Office Action, issued in corresponding Chinese Application No. 20130060304.0, from the Chinese Patent Office, dated Jun. 29, 2016.

International Search Report, dated Jan. 2, 2014, from the Canadian Intellectual Property Office in corresponding International Application No. PCT/CA2013/050794, 2 pages.

Communication pursuant to Rule 62 EPC, from the European Patent Office, issued in Application No. 15783231.2-1658, regarding an extended European Search Report, dated Nov. 3, 2017, 12 pages.

Communication pursuant to Rules 70(2) and 70a(2) EPC, from the European Patent Office, issued in Application No. 15783231.2-1658, dated Nov. 21, 2017, 1 page.

Search Report and Written Opinion, issued from the Intellectual Property Office of Singapore, in corresponding Patent Application No. 11201608816S, dated Nov. 28, 2017, 10 pages.

Third Party Observation in corresponding PCT/CA2016/050838, filed Jul. 15, 2016 (five pages).

Second Office Action issued in corresponding Chinese Application No. 2013/80060304.0, from the Chinese Patent Office, dated May 15, 2017 (19 pages).

Third Office Action issued in corresponding Chinese Application No. 2013/80060304.0, from the Chinese Patent Office dated Feb. 23, 2018 (20 pages).

Decision on Grant, issued by the Russian Patent Office, in corresponding Russian Application No. 2016 145 423 A, (8 pages).

First Office Action Examination Report, issued by the Chinese Patent Office, in corresponding Application No. 2016/80088550.0 (27 pages).

Supplementary European Search Report, issued by the European Patent Office, in corresponding Application No. EP 16 90 8371, dated Jan. 13, 2020 (6 pages).

JP 75956-577, Notice of Reasons for Rejections, issued by the Japanese Patent Office, in corresponding Application No. 2019-501632 (4 pages).

RU Office Notification, issued in Application No. 2019/104086/12(007659), dated Aug. 27, 2019 (7 pages).

RU Search Report, issued in Application No. 2019/104086/12(007659), dated Aug. 16, 2019 (4 pages).

SG Written Opinion, issued by the Intellectual Property Office of Singapore, in corresponding Application No. 11201900151T, (8 pages).

International Search Report, issued by the Canadian Intellectual Property Office, International Application No. PCT/CA2016/050838, dated Mar. 17, 2017, 12 pages.

Communication pursuant to Rule 69 EPC, from the European Patent Office, issued in corresponding Application No. 16192350.3-1658, dated May 3, 2017, 2 pages.

Office Action, issued from the Korean Intellectual Property Office, in corresponding Korean Application No. 10-2015-7013127, 15 pages.

* cited by examiner

AMUSEMENT ATTRACTION FLUID CONTROL SYSTEM

FIELD OF THE INVENTION

The invention relates generally to amusement attractions, and in particular fluid based attractions.

BACKGROUND OF THE INVENTION

In the past few decades, water-based amusement rides have become increasingly popular. Such rides can provide similar thrills to roller-coaster rides, with the additional features of the cooling effect of water and the excitement of being splashed.

The most common water-based amusement rides are flume-style waterslides in which a participant slides along a channel or "flume", either on his or her body, or on or in a vehicle. Water is provided in the flume to provide lubrication between the body/vehicle and the flume surface, and to provide the above-mentioned cooling and splashing effects. Typically, the motion of the participant in the flume is controlled predominantly by the contours of the flume (hills, valleys, turns, drops, etc.) in combination with gravity.

As thrill expectations of participants have increased, demand for greater control of participants' movement in the flume has correspondingly increased. Thus various techniques have been applied to accelerate or decelerate participants by means other than gravity. For example, a participant may be accelerated or decelerated using powerful water jets. Other rides use a conveyor belt to convey a participant to the top of a hill the participant would not otherwise crest on the basis of his or her momentum alone.

Water rides are very popular in hot climates where the cooling effect of water allows participants to enjoy the outdoors when temperatures would otherwise make the outdoor experience unpleasant. Such locations pose challenges because they often have limited water resources, are prone to drought, and may have costly energy. This situation is a deterrent to the construction of water rides which require large volumes of water to operate and utilize significant energy reserves to move the water through the water rides.

SUMMARY OF THE INVENTION

An aspect of the invention relates to an amusement attraction fluid control system comprising: a fluid source; at least one pump; at least one fluid feature; a plurality of conduits interconnecting the fluid source and the at least one pump to the at least one fluid feature; and a controller; wherein the at least one pump is configured to pump fluid through the conduits to the at least one fluid feature; and wherein the controller is adapted to control the at least one pump to deliver fluid to each respective fluid feature.

In some embodiments, the amusement attraction fluid control system further comprises at least one variable frequency drive intermediate the controller and the at least one pump for controlling each of the at least one pump based on input received from the controller.

In some embodiments, the amusement attraction fluid control system further comprises at least one sensor wherein the at least one sensor provides input to the controller.

In some embodiments, the at least one sensor comprises at least one first sensor adapted to detect at least one feature of a participant.

In some embodiments, the feature is at least one of location and velocity.

In some embodiments, the at least one sensor comprises at least one second sensor adapted to detect at least one fluid flow property.

In some embodiments, the at least one fluid flow property is at least one of fluid pressure and rate of fluid flow.

In some embodiments, the at least one fluid feature comprises a plurality of fluid features and the at least one pump comprises a plurality of pumps and wherein each of the plurality of fluid features has at least one associated pump of the plurality of pumps.

In some embodiments, each of the at least one pump is adapted to increase fluid flow rate from the associated fluid feature when the participant is adjacent to the fluid feature and to decrease fluid flow rate from the associated fluid feature when the participant is at a distance from the fluid feature.

In some embodiments, the amusement attraction fluid control system further comprises a variable frequency drive associated with each of the at least one pump for controlling the fluid flow rate from the at least one pump.

Another aspect of the invention relates to a waterslide section comprising the amusement attraction water control system and a sliding surface wherein each fluid feature is a water feature and each at least one pump is adapted to increase flow of water to each respective water feature as a participant slides toward the respective water feature and to decrease flow of water to the respective water feature as the participant slides away from the water feature.

In some embodiments, the fluid features are water spray sources.

Another aspect of the invention relates to an amusement attraction comprising the amusement attraction fluid control system and a water slide wherein the plurality of fluid features are associated with the water slide.

Another aspect of the invention relates to an amusement attraction comprising the amusement attraction fluid control system and a water play structure wherein the plurality of fluid features are associated with the water play structure.

Another aspect of the invention relates to an water play attraction water control system comprising: a water source; a pump; a plurality of water features; a plurality of conduits interconnecting the water sources and pump to the plurality of water features; and each of the plurality of water features having a respective associated valve; wherein the pump is configured to pump water through the conduits to the water features; wherein each respective associated valve is adapted to open to deliver water to each respective water feature.

In some embodiments, the amusement attraction water control system further comprises at least one sensor wherein at least one of the associated valves is movable between open and closed positions based on input from the at least one sensor.

In some embodiments, the at least one sensor comprises a plurality of sensors wherein each respective associated valve has a respective associated sensor.

Another aspect of the invention relates to an amusement ride vehicle motion control system comprising: a channel; a plurality of fluid spray sources positioned to spray fluid over the channel; at least one first sensor adapted detect when the amusement ride vehicle enters a zone of the channel; at least one pump associated with the plurality of fluid spray sources; and a controller adapted to increase the fluid flow by the at least one pump to the respective fluid spray sources in response to an amusement ride vehicle entering the zone.

In some embodiments, the amusement ride vehicle motion control system further comprises at least one second sensor adapted to detect when the amusement ride vehicle leaves the zone of the channel, the controller being adapted to reduce the pump output to decrease the flow from the fluid spray source in response to the amusement ride vehicle exiting the zone.

In some embodiments, the amusement ride vehicle motion control system further comprises: a second plurality of fluid spray sources positioned to spray fluid over the channel; at least one third sensor adapted detect when the amusement ride vehicle enters a second zone of the channel at least one second pump associated with the second plurality of fluid spray sources; and the controller being adapted to increase the fluid flow by the at least one second pump to the respective second plurality of fluid spray sources in response to an amusement ride vehicle entering the zone.

In some embodiments, the respective pumps are connected to the controller by a variable frequency drive, wherein the respective variable frequency drives are adapted to control the rate of the respective pumps In some embodiments, the channel comprises a sliding surface and the vehicle is adapted to slide on the sliding surface.

In some embodiments, the channel is adapt to hold sufficient fluid to float the vehicle and the vehicle is adapted to float in the channel.

In some embodiments, the channel is upwardly angled and the fluid spray sources are positioned to exert force on the vehicle to boost the vehicle up the channel.

In some embodiments, the channel is horizontal and the fluid spray sources are positioned to exert force on the vehicle to accelerate the vehicle along the channel.

Another aspect of the invention relates to a method of affecting the motion of a vehicle in a sliding on a waterslide comprising: providing a channel in the waterslide; positioning a plurality of water spray sources to spray water at a vehicle in the channel; sensing when the vehicle is enters the channel; increasing a rate of a pump to spray water from the water spray sources at a pressure and flowrate to affect motion of the vehicle.

In some embodiments, the method further comprises sensing when the vehicle is exiting the channel; and decreasing the rate of the pump to reduce the spray water from the water spray sources.

In some embodiments, the method further comprises operating a variable frequency drive to control the rate of the pump.

In some embodiments, the channel is upwardly angled, the method comprising operating the fluid spray sources to exert force on the vehicle to boost the vehicle up the channel.

In some embodiments, the channel is horizontal, the method comprising operating the fluid spray sources to exert force on the vehicle to accelerate the vehicle along the channel.

Another aspect of the invention relates to an amusement ride vehicle comprising: a body and at least one of recesses and protrusions on a perimeter surface of body, the at least one of recesses and protrusions defining fluid impact surfaces, the fluid impact surfaces being at an angle to an intended direction of motion of the vehicle to affect motion of the vehicle when the fluid impact surfaces are impacted by a fluid.

In some embodiments, at least a portion of an underside of the body is adapted to slide on a sliding surface.

In some embodiments, the vehicle is adapted to float in a fluid.

In some embodiments, the at least one of recesses and protrusions comprise a plurality of recesses or a plurality of protrusions spaced along opposite sides of the vehicle body.

In some embodiments, the vehicle comprises outer sidewalls and a bottom surface and the plurality of recesses or the plurality of protrusions do not extend outward past the outer sidewalls or beneath the bottom surface of the vehicle body or above the top surface of the vehicle.

In some embodiments, the vehicle comprises sides and a bottom and the plurality of recesses or the plurality of protrusions are located beneath the sides and adjacent the bottom of the body.

In some embodiments, the vehicle body has a forward end and a rearward end, wherein the at least one of recesses and protrusions have an inward end and an outward end, and wherein the inward end of the at least one of recesses and protrusions is closer to the front end than to the rear end such that the at least one of recesses and protrusions are angled forward.

In some embodiments, the fluid impact surfaces face the rear end on the vehicle body and are concave.

In some embodiments, the at least one of recesses and protrusions are removable and repositionable.

In some embodiments, the amusement ride vehicle of further comprises at least one channel, wherein the at least one of recesses and protrusions are connected to the at least one channel for directing water away from the fluid impact surface after impact.

In some embodiments, the at least one channel comprises a plurality of channels and each of the at least one of recesses and protrusions are connected to respective channels of the plurality of channels.

In some embodiments, at least some of the plurality of channels are interconnected.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the invention will now be described with reference to the attached drawings in which.

DETAILED DESCRIPTION OF THE EMBODIMENTS OF THE INVENTION

Figure 1:
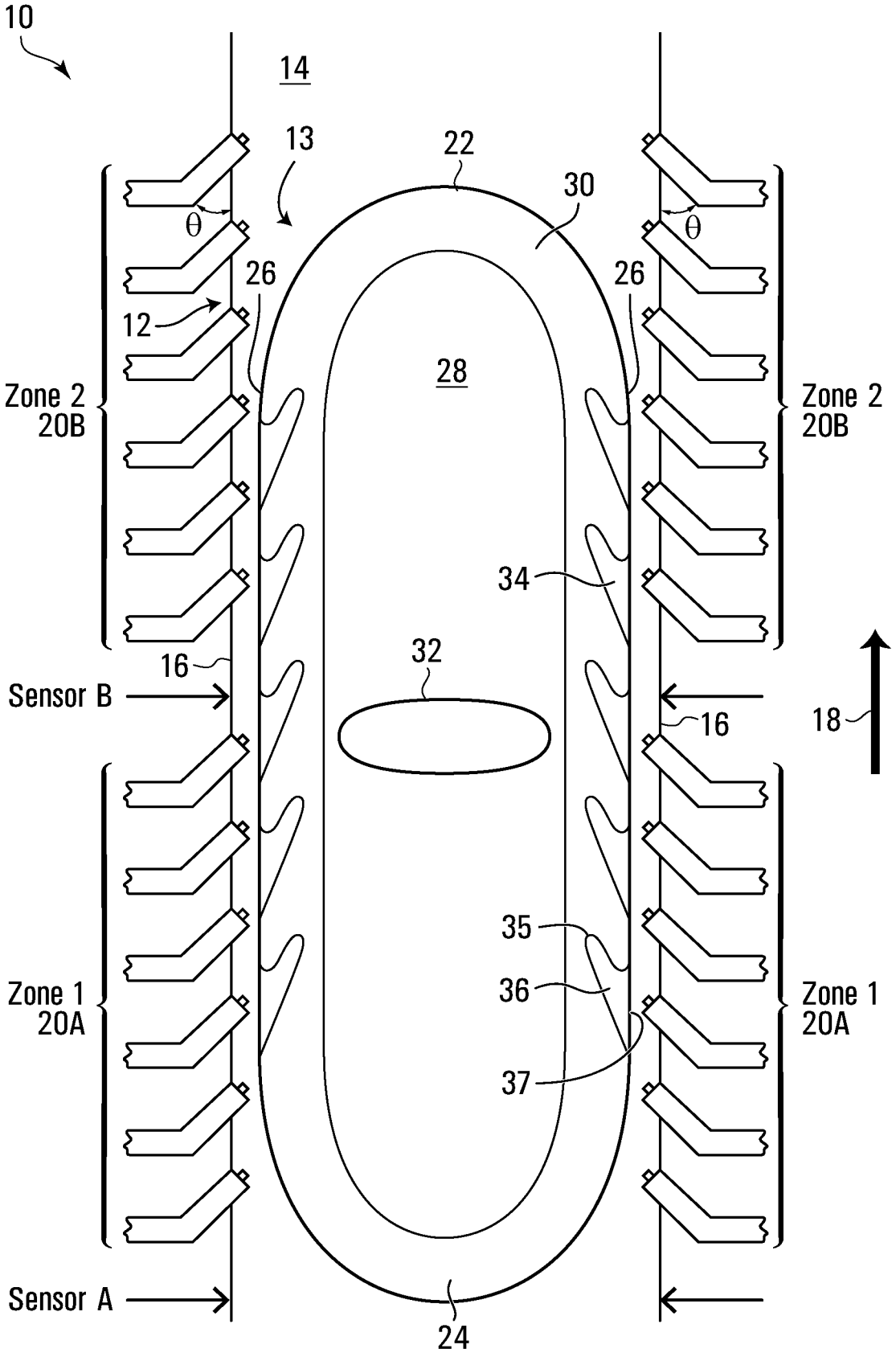
FIG. 1 is a schematic top view of an amusement ride vehicle control system according to an embodiment of the invention.

FIG. 1 shows a first embodiment of an amusement ride motion control system 10. The system 10 includes a channel 12 and a vehicle 13. Only a portion of the channel 12 is depicted in FIG. 1. The channel 12 may comprise a flume style slide having a central sliding surface 14 between side walls 16. The sliding surface may be lubricated with water, as in a traditional flume ride, or may have a low friction coating. The channel 12 may alternatively be a water filled channel in which there is sufficient fluid that the vehicle 13 may float or the vehicle may include wheels and may roll or otherwise move. The wall 16 may be closely adjacent the path of the vehicle 13 on sliding surface 14 to assist in guiding the vehicle along a predetermined path, or spaced further away from an indeterminate path of the vehicle 13.

In this embodiment, the channel 12 shows two zones, namely Zone 1 and Zone 2. A direction of travel of the vehicle 13 along the channel 12 is from Zone 1 to Zone 2 as indicated by the arrow 18. At the entrance to Zone 1, one or more sensors A may be positioned. The sensors A may be any type of sensor which can detect the entrance of the vehicle 13 into Zone 1. Similarly, at the entrance of Zone 2 from Zone 1, one or more sensors B may be positioned. The sensors B may also be any type of sensor which can detect the entrance of the vehicle 13 into Zone 2. The sensors may also be omitted or may be present only at Zone 1 or Zone 2 but not at both.

Spaced along the walls 16 are fluid injectors such as water jet or spray sources 20A and 208B. The first spray sources 20A are located in Zone 1 and the second spray sources 20B are located in Zone 2. In this embodiment, four spray sources 20A, 20B are depicted in each of Zones 1 and 2 which are laterally aligned with each other in pairs along the walls 16. In other embodiments, more or fewer spray sources 20A and 20B may be provided. In this embodiment, the fluid sprayed from the spray sources is water. In other embodiments, a different fluid may be sprayed, such as air, gas, other liquids, solid/liquid suspensions or combinations thereof or other gas. In some embodiments the spray source sprays horizontally; in other embodiments, the spray sources may spray at an upward or downward angle. In some embodiments the spray sources 20A and 20B may be narrowly focused to provide a jet of fluid; in other embodiments, the spray may be less focused.

In the present embodiment, the spray sources 20A, 208B are angled to direct water at an angle θ towards the direction of travel of the vehicle 13. In this embodiment, the angle θ of the spray sources 20A, 208B indicates the angle at which the water will be sprayed from the spray sources 20A, 20B into the channel 12. The angle θ in this embodiment is approximately 10° to 15° from the wall 16. In other embodiments the spray sources 20A, 20B may be directed at other angles to the direction of travel.

The spray sources may alternatively be perpendicular to the direction of travel, for example, to spin a round vehicle, or angled in a reverse direction, for example, to slow the velocity of the vehicle 13.

The spray sources 20A, 20B may include a spray nozzle and a source of fluid which is pressurized or pumped out through the spray nozzle. In this embodiment, the pressure of the spray may be about 30-60 PSI and the volume of the spray or rate of fluid flow may be about 25-55 GPM. However, the exact pressure, volume and spray or jet pattern, whether narrowly focused or expansive, will be determined based on the requirements of the particular system. Additionally, the spray sources 20A, 20B may vary from each other and may be controllable with regards to pressure, volume, spray pattern and direction.

The vehicle 13 of this embodiment is a raft type vehicle with a front end 22, a rear end 24, sides 26, and a bottom 28. As seen from the top in the schematic view of FIG. 1, the vehicle 13 has a roughly elongated oval shaped body. An inflated tube 30 extends around the perimeter of the body of vehicle 13 and defines the front end 22, rear end 24 and sides 26. The bottom 28 connects to the bottom surface (not shown) of the inflated tube 30 to define an interior of the vehicle 13 for carrying passengers. In this embodiment, the vehicle 13 also includes a center partition 32. The vehicle 13 may accommodate two riders, one in front of and one behind the partition 32. It will be understood that the vehicle 13 is merely exemplary and other embodiments of the invention include numerous vehicle styles, as discussed further in respect to FIGS. 10A to 10E.

In this embodiment, as noted above, the sides 26 are defined by the inflated tube 30. The inflated tube 30 may have a circular cross section such that the outer side walls of the vehicle 13 are curved. A series of recesses or intakes 34 are defined into the sides 26. In this embodiment, five mirror image pairs of recesses are spaced substantially equally along the sides 26 of the vehicle 13. In other embodiments there may be more or fewer pairs of recesses such as 7 or 10 based on system requirements. The recesses 34 are angled in the direction of travel of the vehicle 13. The angle of the recesses 34 is substantially the same as the angle of the spray sources 20A, 20B such that, when spray from the spray sources 20A, 20B is aligned with one of the recesses 34, the fluid sprays directly into the respective recesses 34 and impacts against the interior or impact surface 36.

Each of the recesses 34 is concave and has an inward end 35 and an outward end 37. As can be seen from FIG. 1, inward ends 35 of the recesses 34 are further from the rear end 24 than from the front end 22 such that the recesses 34 are angled forward. With this configuration, the fluid impact surfaces 36 face the rear end 24 on the vehicle body and are concave.

In some embodiments, the shape of the recesses 34 and the angle θ of the spray sources 20A, 20B, is based on the Pelton Wheel turbine design.

It will be appreciated that the force of the fluid against the impact surfaces will affect the motion of the vehicle. The force imparted by the fluid impacting against the impact surfaces within the sides 26 of the vehicle 16 may be more effective in propelling the vehicle 13 in the intended direction of travel than water impacting against the side of a comparable vehicle without such recesses resulting in a more efficient energy transfer for the water to the vehicle motion. This may result in a significant decrease in power and water consumption and in noise. The system may also be able to propel heavier vehicles based on the increased efficiency and boost vehicles up inclines or accelerate vehicles on horizontal surfaces.

Figure 2:
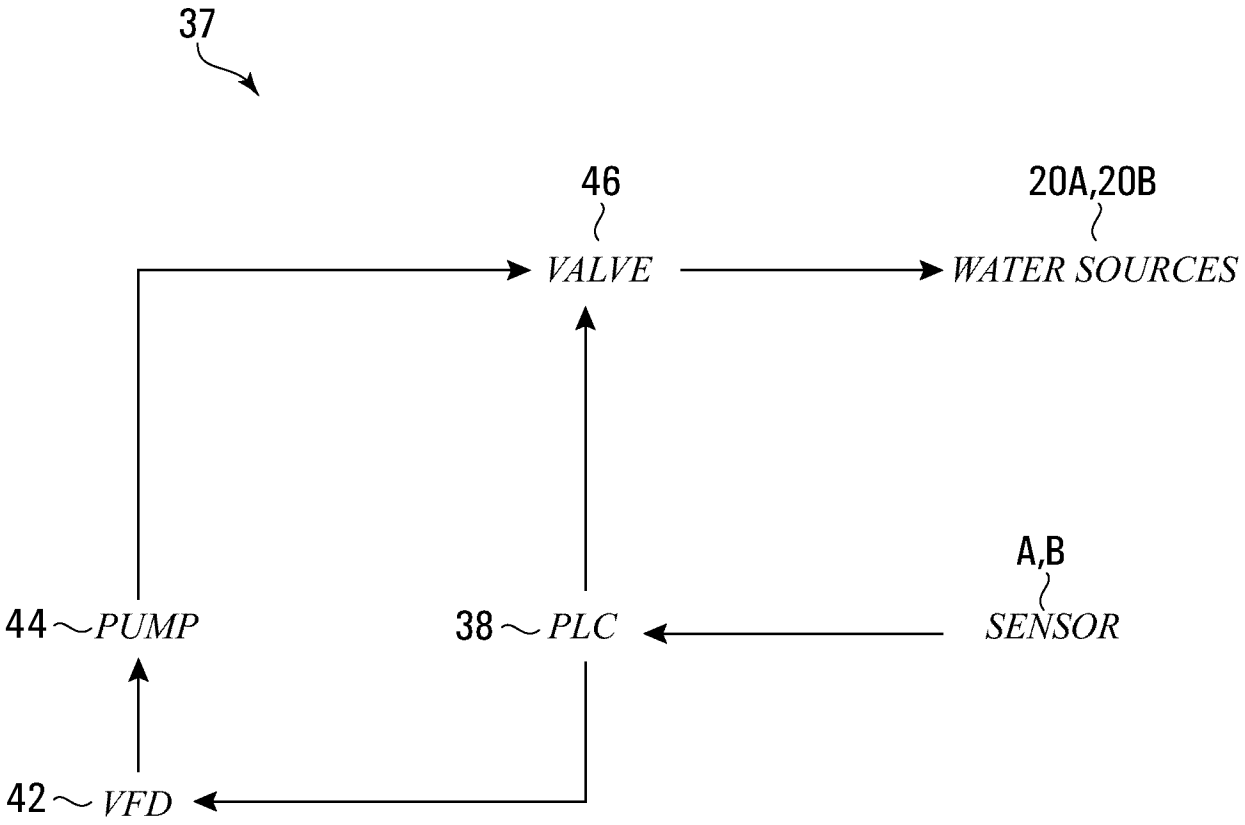
FIG. 2 is a schematic view of a control system for the amusement ride vehicle control system of FIG. 1.

FIG. 2 is a schematic view of an exemplary control system 37 for the amusement ride motion control system 10 of FIG. 1. In this control system, the sensors A, B provide input to a programmable logic controller (PLC) 38. The PLC 38 is connected to one or more valves 40 for controlling the flow of water to the spray sources 20A, 20B. The PLC 38 may receive signals and input from sensors as well as other sources such as an operator or user through a user interface. The PLC 38 may also be connected to a variable frequency drive (VFD) 42 which receives input from and is controlled by the PLC 38. The VFD 42 is in turn connected to a pump 44 for controlling the flow of water to the valves 40 and ultimately to the spray sources 20A, 20B.

It will be appreciated that control system 37 may be modified to eliminate some of these components. For example, the VFD 42 may be eliminated and an alternative means of driving the pump may be supplied. The valves may be eliminated and the VFD 42 alone may be used to control the flow of water from the pump 44. In either embodiment (i.e. with or without the use of valves), there may be one pump and an associated VFD for each zone and group or bank of spray sources.

The programmable logic controller (PLC) 38 may be eliminated and an alternative control means used. In addition, the control system 37 and the sensors 20A, 20B may be completely eliminated and the spray sources 20A, 20B may be directly connected to the pump 44 or other source or fluid which flows constantly to provide a constant delivery of fluid to the spray sources 20A, 20B and a consequent constant spray from the spray sources 20A, 20B or other such fluid features.

Figure 3:
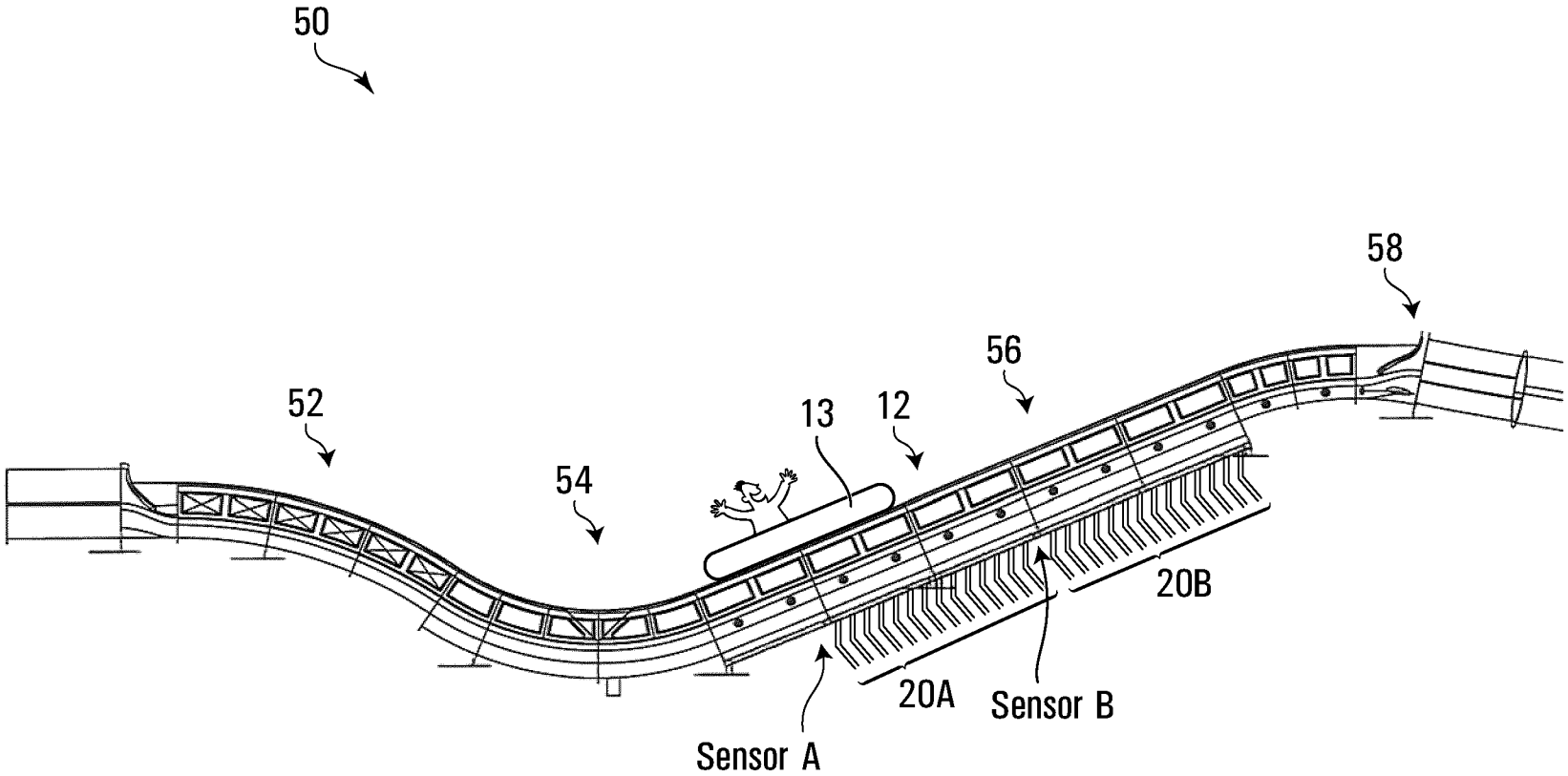
FIG. 3 is a schematic side view of a section of an amusement ride which incorporates the amusement ride vehicle control system of FIG. 1.

FIG. 3 shows a schematic side view of a zone or section 50 of an amusement ride which incorporates the control system according to the embodiment of FIGS. 1 and 2. In this embodiment, the section 50 includes an initial downward portion 52, a transitional concave or valley portion 54 and a subsequent upward portion 56 and a final slightly declined portion 58. The described portions and curvatures are exemplary only. Numerous other arrangements of upward, downward horizontal and transitional sections at various angles are also possible.

The vehicle 13 and the channel 12 are shown in FIG. 3 on the upward portion 56. It will be appreciated that the channel 12 could also form a horizontal section or an upward curved section. The channel 12 is depicted without the sidewalls 16. The positioning of the sensors A, B and the spray sources 20A, 20B are also shown schematically. It will be appreciated, that a vehicle initially travelling down the downward portion 52 may not have enough momentum to travel up the upward portion 56 without the application of an external force. The operation of the control system 37 to provide the external force will be described with reference to FIGS. 1 to 4C.

Figures 4A, 4B, 4C:
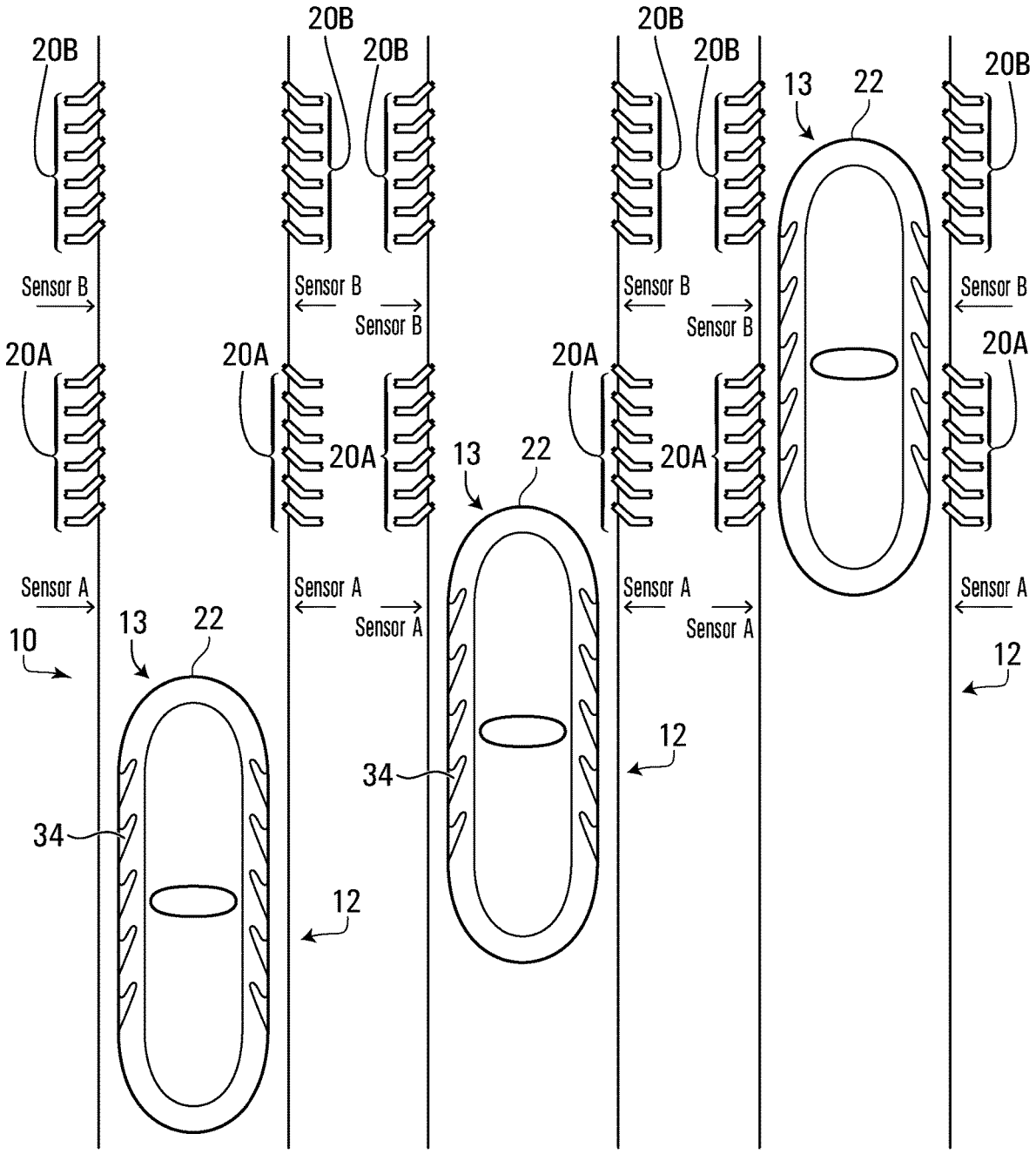
FIGS. 4A, 4B and 4C are schematic top views of the amusement ride vehicle control system of FIG. 1 with the vehicle shown in three different positions.

FIGS. 4A to 4C show the vehicle 13 in three different locations as it travels along the channel 12. In the first position, shown in FIG. 4A, which is equivalent, for example, to the valley portion 54 in FIG. 3, the vehicle 13 has not yet reached the sensor A. The control system 37 has not detected the vehicle 13 and the spray sources 20A, 20B are not spraying fluid or are spraying at a low pressure and volume.

In FIG. 4B, the front end 22 of the vehicle 13 is just passing the sensors A. When this happens, the sensors A detect the presence of the vehicle 13. The information is transmitted to the PLC 38. The PLC 38 in turn activates the VFD 42 to power the pump 44 to spray fluid such as water or air from the sources 20A. In some embodiments, the VFD 42 and pump 44 may already be running, and the PLC 38 will only activate the valves. At the same time, the PLC 38 opens the valves 40 associated with the spray sources 20A so that the fluid pumped by the pump 44 sprayed out through the spray sources 20A. The fluid sprayed out through the spray sources 20A, which may be jets of water, impacts in the recesses 34 as described with reference to FIG. 1. The force imparted by the fluid from the spray source 20A provides momentum to push the vehicle 13 up the upward section 56, as shown in FIG. 3. In the position of FIG. 4B, the vehicle 13 has not yet reached the sensors B and thus the spray sources 20B are not spraying fluid.

In FIG. 4C, the front end 22 of the vehicle 13 has passed the sensors B. When this happens, the sensors B detect the presence of the vehicle 13. The information is transmitted to the PLC 38. Since the PLC 38 has already activated the VFD 42 to power the pump 44 to spray fluid from the sources 20A, in some embodiments it may be unnecessary for the PLC 38 to communicate with the VFD 42. In other embodiments, it may be necessary for the PLC 38 to communicate with the VFD 42 to increase the fluid pressure for pumping from the additional spray sources 20B. In either case, the PLC 38 opens the valves associated with the spray sources 20B so that the fluid pumped by the pump 44 sprayed out through the spray sources 20B. The fluid sprayed out through the spray sources 20B also impacts in the recesses 34 as described with reference to FIG. 1. The force imparted by the fluid from the spray source 20B also provides momentum to push the vehicle 13 up the upward section 56, as shown in FIG. 3.

In some embodiments, the spray sources 20A, 20B will provide sufficient momentum to push the vehicle 13 up the upward section 56 and onto the declined section 58. In other embodiments, the upward section 56 may contain further sensors and associated spray sources to provide added momentum. In some embodiments, the PLC 38 will control the spray sources to spray for a defined length of time. In some embodiments, the control system 37 will incorporate further sensors that will turn off the sources of water spray when the vehicle 13 is detected by those sensors.

In some embodiments, rather than having the sensors along the uphill portion 56, there may be sensors at the entrance to the section 50. The sensors may activate the spray sources, either simultaneously or sequentially, when the vehicle is detected entering the section 50. In this embodiment, the spray sources may be activated for a specific period of time or there may be additional sensors at the end of the section 50 for turning off the spray sources when a vehicle is detected.

In some embodiments, the sensors may be omitted and the spray sources activated a defined period of time after a vehicle has commenced the ride. It will be appreciated that numerous other control arrangements are possible.

In some embodiments, the spray sources 20A, 20B may be a solid stream nozzle or a spray nozzle. The nozzle may have a diameter in the range of ¼ inch to 2 inches. The nozzle may be in the range of 0° to 15°. The flow rate through the nozzles may be in the range of 5 to 50 gallons per minute.

Figure 5A:
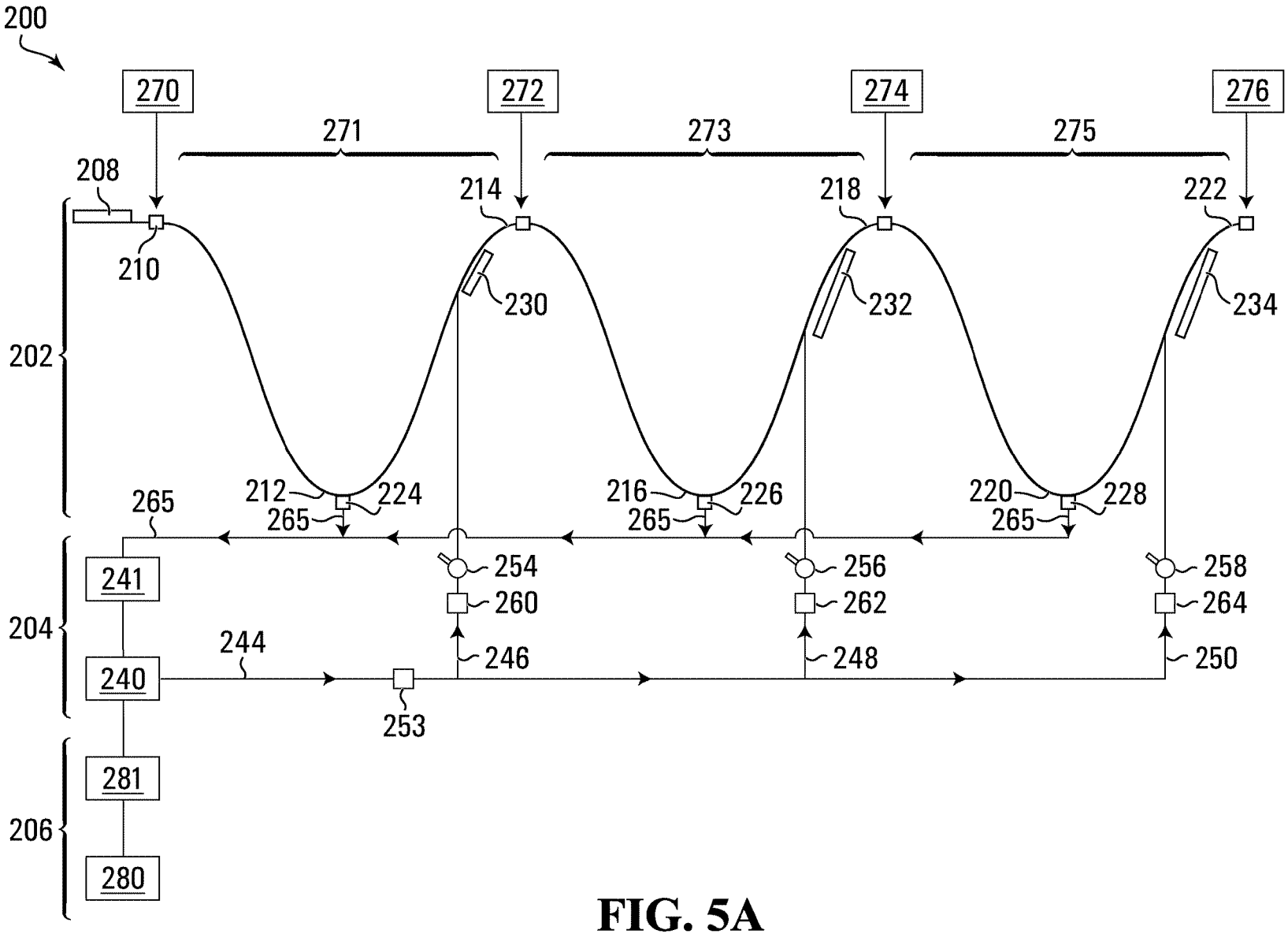
FIG. 5A is a schematic view of an amusement ride feature according to another embodiment of the invention.

FIG. 5A is a schematic view of a section of an amusement ride 200. The section 200 includes a slide path 202, a fluid system 204, and a control system 206.

As described in respect to FIG. 1, the slide path may be defined by a channel such as a flume style slide having a central sliding surface between side walls. The sliding surface may be lubricated with water, as in a traditional flume ride, or may have a low friction coating. The channel may alternatively be a water filled channel in which there is sufficient fluid that a vehicle may float or the vehicle may include wheels and may roll or otherwise move. Walls may be closely adjacent the sliding surface to assist in guiding the vehicle along a predetermined path, or spaced further away from an indeterminate path of the vehicle.

In FIG. 5A, the slide path 202 is shown in profile. For example, a vehicle 208 starts from an elevated entry point 210. The slide path 202 is an undulating path with the path being downward from the entry point 210 to a first valley 212, upward to a first local peak 214, downward to a second valley 216, upward to a second local peak 218, downward to a third valley 220 and upward to a third local peak 222. It will be understood that the ride profile used is exemplary and numerous other ride profiles may be used including a purely planer, uphill or downhill profile.

In this embodiment, one or more of the first, second and third valleys 212, 216 and 220 may include first, second and third drains 224, 226 and 228, respectively, or other means for removing water which may accumulate at these relatively low areas of the slide path 202. Along the slide path between the first, second and third valleys 212, 216 and 220 and the respective first, second and third local peaks 214, 218 and 222 are banks of spray sources 230, 232 and 234.

The banks of spray sources 230, 232 and 234 may be arranged in the same manner as the sprays sources 20A, 20B described in respect to FIG. 1. In particular, the banks of spray sources 220, 232 and 234 may consist of individual spray sources spaced along the walls of the slide path 202 and may include laterally aligned pairs along the opposite walls. In the present embodiment, the spray sources may be angled to direct water at an angle towards the direction of travel of the vehicle to apply a force to the vehicle to propel the vehicle along the slide path 202.

In this embodiment, the first, second and third banks of spray sources 230, 232 and 234 extend from an intermediate point along the incline between the first, second and third valleys 212, 216 and 220 and their respective first, second and third local peaks 214, 218 and 222 to approximately the respective first, second and third local peaks 214, 218 and 222. However, the number and position of each of the sprayers in the first, second and third banks of spray sources 230, 232 and 234 as well as the location of the first, second and third banks of spray sources 230, 232 and 234 will vary and will depend on the desired thrust force and duration needed, for example, to ensure that a vehicle travelling the slide path 202 has enough momentum to travel up and over each of the first, second and third local peaks 214, 218 and 222.

It will be appreciated that one or all of the first, second and third spray sources 230, 232 and 234 may be replaced with other ride features such as misters or water cannons, particularly for other ride profiles which may have different water requirements.

The first, second and third drains 224, 226 and 228 and the banks of spray sources 230, 232 and 234 provide an interface between the slide path 202 and the fluid system 204.

The fluid system 204 directs the water used by the amusement ride 200. The fluid system 204 includes a pump 240 and a series of conduits. The conduits include both outgoing conduits from the pump 240 and return conduits to return water to the pump 240. Associated with the pump 240 may be an accumulation tank, reservoir or other water source to accumulate returned water until it is needed to be pumped to the slide path 202 again, and to replenish the fluid system 204 as water is lost, for example, from evaporation and splashing out of the amusement ride 200.

In the present embodiment, the fluid system 204 includes main outgoing conduit 244, and first, second and third branch outgoing conduits 246, 248 and 250 respectively. The main outgoing conduit 244 is in fluid communication with each of the branch outgoing conduits 246, 248 and 250. The main outgoing conduit 244 and the first branch outgoing conduit 246 together connect the pump 240 to the first bank of spray sources 230. Similarly, the main outgoing conduit 244 and the second branch outgoing conduit 248 together connect the pump 240 to the second bank of spray sources 232, and the main outgoing conduit 244 and the third branch outgoing conduit 250 together connect the pump 240 to the third bank of spray sources 234. It will be appreciated that there are numerous means by which pressurized fluid can be provided to the first, second and third bank of spray sources 230, 232 and 234. For example, the main outgoing conduit 244 could be eliminated and each of the first, second and third branch outgoing conduits 246, 248 and 250 could be directly connected to separate pumps, rather than the single pump 240.

The first, second and third branch outgoing conduits 246, 248 and 250 may also include first, second and third flow valves 254, 256 and 258 and first, second and third check valves 260, 262 and 264, respectively. In the present embodiment, the first, second and third check valves 260, 262 and 264 are between the main outgoing conduit 244 and the first, second and third flow valves 254, 256 and 258. In other embodiments, one or more check valves may instead be provided on the main outgoing conduit 244. In some embodiments the first, second and third check valves 260, 262 and 264 may instead be positioned between the first, second and third flow valves 254, 256 and 258 and the banks of spray sources 230, 232 and 234 respectively. The opening and closing of the first, second and third flow valves 254, 256 and 258 and the first, second and third check valves 260, 262 and 264 may be controlled by the control system 206 as further detailed below.

The first, second and third drains 224, 226 and 228 may connect to return conduits 265 which channel the drained water back to the pump 240 or associated holding tank or fluid source or reservoir 241.

Sensors may be provided along the slide path 202 to record and transmit information concerning the vehicle 208 traversing the slide path 202. In this embodiment, an entry sensor 270 is provided at the entry point 210 of the slide path 202. First, second and third sensors 272, 274 and 276 are provided at each of the first, second and third local peaks 214, 218 and 222 respectively. The section of the ride between the entry sensor 270 and the first sensor 272 is a first zone 271, the section of the ride between the first sensor 272 and the second sensor 274 is a second zone 273, and the section of the ride between the second sensor 274 and the third sensor 276 is a third zone 275. The entry, first, second and third sensors 270, 272, 274 and 276 may measure various parameters or characteristics of a participant or the vehicle 208. For example, in some embodiments, the entry, first, second and third sensors 270, 272, 274 and 276 may only measure the location or passage of the vehicle 208. In other embodiments, one or more of the entry, first, second and third sensors 270, 272, 274 and 276 may measure different and/or additional parameters such as velocity.

The entry, first, second and third sensors 270, 272, 274 and 276 form part of the control system 206. The control system 206 includes a controller, such as a programmable logic control (PLC) 280. In FIG. 5A, the PLC 280 is shown as connected to the pump 240 through an optional variable frequency drive (VFD) 281. For clarity, the electrical connection of the various elements of the control system is show in FIG. 5B.

Figure 5B:
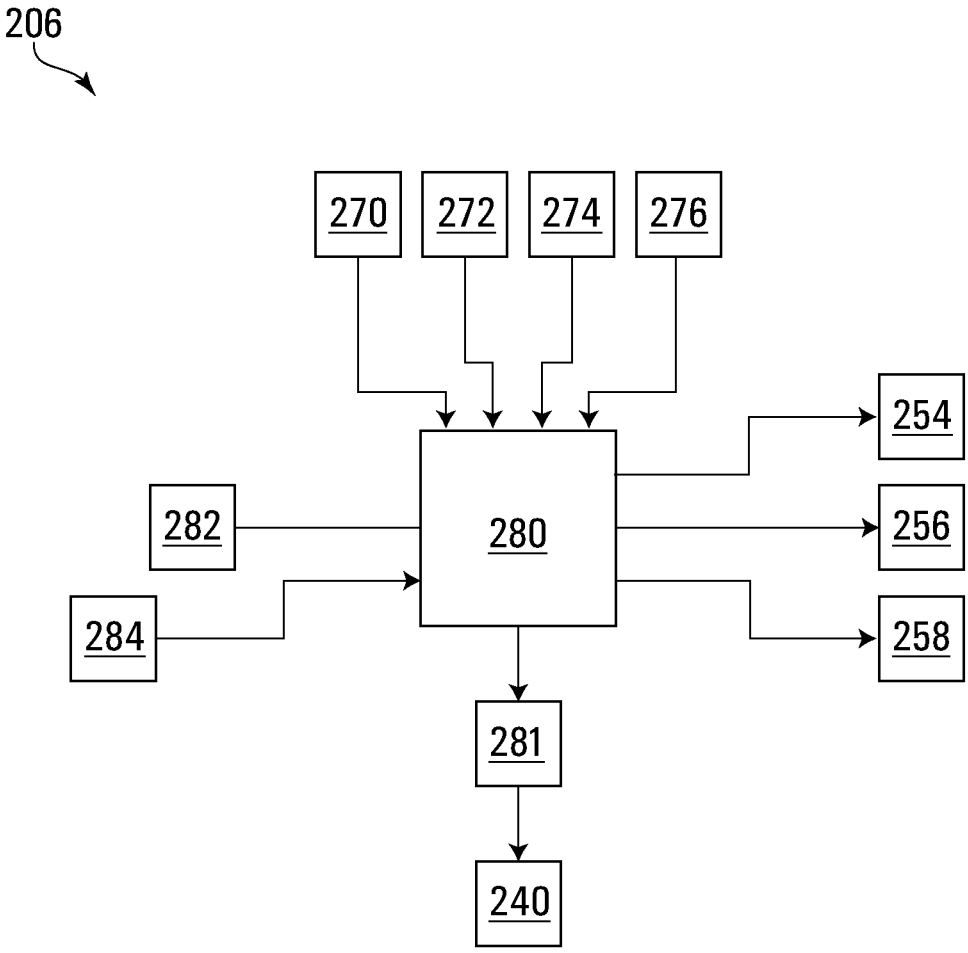
FIG. 5B is a schematic view of the control system of the embodiment of FIG. 5A.

As can be seen FIG. 5B, the entry, first, second and third sensors 270, 272, 274 and 276 are connected to the PLC 280. The first, second and third flow valves 254, 256 and 258 are also connected to the PLC 280 and may provide input to and receive output from the PLC 280 as part of the control system 206. The control system 206 may also include a user interface 284 and a storage device 282 connected to the PLC 280. The PLC 280 may be directly connected to the pump 240 or may be connected to the pump 240 through a variable frequency drive (VFD) 281. The VFD 281 may be used to modulate the operation of the pump, particularly during the opening and closing of the valves so that the pump output is at the required level. The connections of the PLC 280 to the other elements of the control system is shown schematically only. It will be appreciated that there are numerous connection structures possible including wireless connections. In some embodiments, the VFD may be replaced by a direct over line (DOL) device such as a mechanical contractor. Such a contractor may act as a relay to provide power to the pump 240 based on the control of the PLC 280.

The speed of the pump 240 may be regulated for energy conservation during quiet times when a ride can go for many minutes without a rider. The pump 240 may be turned down to some lower rate of flow level, one which does not significantly affect the water balance of the entire mechanical system, but that which realises significant energy and noise reductions. When the system needs to return to normal operation again, most likely actuated by an operator push button or through the user interface 284. The system may register in some way to the operator whether it is safe or not to use e.g. a visual indicator such as a red/green traffic light system, or a boom gate restricting access to the slide feature.

In one exemplary mode of operation, the first, second and third flow valves 254, 256 and 258 will initially be closed and no water will flow through the first, second and third banks of spray sources 230, 232 and 234. The first, second and third check valves 260, 262 and 264 are oriented to allow water to flow from the pump 240 in the outgoing flow direction to the first, second and third flow valves 254, 256 and 258 but not in the reverse direction.

The vehicle 208 will slide past the entry sensor 270 on the water lubricated slide path 202. The entry sensor 270 will register the presence of the vehicle 208 and communicate this to the PLC 280. The PLC 280 will activate the pump 240, through the VFD 282. The PLC will also open the first flow valve 254 to allow water pumped to travel through the main outgoing conduit 244 and the first branch conduit 246. The water will be pumped through the first flow valve 254 and out through the first bank of spray sources 230. In the mean time, the vehicle 208 is continuing to slide down into the first valley 212 and then up toward the first local peak 214. As the vehicle 208 travels upward, the velocity of the vehicle 208 will slow. When the vehicle 208 moves past the first bank of spray sources 230, the bank of spray sources 230 will spray water against the vehicle 208 and provide force to help push the vehicle 208 up to the first local peak 214, as described above with respect to FIGS. 1 to 4.

As the vehicle 208 travels over the first local peak 214, the vehicle 208 passes the first sensor 272. The first sensor 272 will register the presence of the vehicle 208 and communicate this to the PLC 280. The PLC 280 may increase the pump rate of the pump 240, for example, through the ramp up of the frequency of the power supplied to the pump by the VFD 281 to increase the water flow rate and pressure. The PLC 280 will also open the second flow valve 256 to allow water pumped to travel through the main outgoing conduit 244 and the second branch conduit 248. The water will be pumped through the second flow valve 256 and out through the second bank of spray sources 232. In the meantime, the vehicle 208 is continuing to slide down into the second valley 216 and then up toward the second local peak 218. As the vehicle 208 travels upward, the velocity of the vehicle 208 will slow. When the vehicle 208 passes the second bank of spray sources 232, the spray sources 232 will spray water against the vehicle 208 and provide force to help push the vehicle 208 up to the second local peak 218.

At the same time, since the vehicle 208 has passed the first bank of spray sources 230, the flow from these sources can be discontinued to reduce water requirements and energy consumption. To do so, the PLC 280 closes the first flow valve 254. The timing of the closing of the first flow valve 254 may be immediate after the vehicle 208 passes the first local peak 214 or may be delayed. For example, depending on the water pressure in the first branch conduit 246 and the rating of the first flow valve 254, the immediate closing of the first flow valve 254 under pressure may be detrimental to the first flow valve 254. The PLC 280 may await a reduction in pressure in the first branch conduit 246, for example, from the opening of the second flow valve 256 or from an adjustment of the pump output 240 by the PLC 280 through the VFD. In some embodiments, the first flow valve 254 may operate independently to close automatically when the pressure in the first branch conduit 246 reaches a predetermined level. In other embodiments, a sensor in the first flow valve 254 or in the first branch conduit 246 may provide feedback to the PLC 280 and the PLC will control the closing of the first flow valve 254.

The conduits may also include one or more pressure relief or discharge valves 253. Although a single pressure relief valve 253 is depicted in the main outgoing conduit 244, it will be appreciated that such pressure relief valves may be installed throughout the system as needed to bleed off excessive pressure during valves changeover and to mitigate any damage to the flow valves 254, 256 and 258 during switching the valves back and forth between open and closed positions.

In other embodiments, the closing of the first flow valve 254 may be controlled by a timer which is set based of flow calculations or measurements based on the size and length of the conduits, pump pressure and volume, the opening of the second flow valve and other know system variable used in designing a particular system. Where ride participants are introduced to the ride at predetermined intervals, for example, by the use of a belt conveyor or push button loading controlling participant dispatch rate, the timing of participants may be well know and used to control the operation of the valves. The valve could also be controlled by an operator.

In some embodiments the first flow valve 254 may not be completely closed but may instead be partially opened to maintain a reduced flow of water to the first bank of spray sources 230. Even when the first flow valve 254 is completely closed, the first check valve 260 will prevent the water from draining back through the first check valve 260. The first check valve 260 may also be positioned on the other side of the first flow valve 254, or may be omitted.

Check valves may also be situated elsewhere in the fluid system 204 to help control water flow and retention in the fluid system 204.

As the vehicle 208 travels over the second local peak 218, the vehicle 208 passes the second sensor 274. The second sensor 274 will register the presence of the vehicle 208 and communicate this to the PLC 280. The PLC 280 may increase or otherwise adjust the parameters, such as the pump rate, of the pump 240, through the VFD 281 (if present). The PLC will also open the third flow valve 258 to allow water pumped to travel through the main outgoing conduit 244 and the third branch conduit 250. The water will be pumped through the third flow valve 258 and out through the third bank of spray sources 234. In the meantime, the vehicle 208 is continuing to slide down in to the third valley 228 and then up toward the third local peak 222. As the vehicle 208 travels upward, the velocity of the vehicle 208 will slow. When the vehicle 208 reaches the third bank of spray sources 234, the spray sources 234 will spray water against the vehicle 208 and provide force to help push the vehicle 208 up to the third local peak 222.

In a comparable manner to the first flow valve 254, the second flow valve 256 will be partially or completely closed with the second check valve 262 operating in a comparable manner to the first check valve 260 to maintain water in the flow system 204.

As the vehicle 208 travels over the third local peak 222, the vehicle 208 passes the third sensor 276. The third sensor 276 will register the presence of the vehicle 208 and communicate this to the PLC 280. In a comparable manner to the first and second flow valves 254 and 256, the third flow valve 258, will be partially or completely closed with the third check valve 264 operating in a comparable manner to the first and second check valves 260 and 262 to maintain water in the flow system 204.

Throughout operation of the fluid and control systems 204 and 206, respectively, water which accumulates in the first, second and third valleys 212, 216, and 220 may be drain through the first, second and third drains 224, 226 and 228 and return to the pump 240 through the return conduits 265.

It will be appreciated that the use of check valves 260, 262 and 264 may reduce the time for the required pressure and flow rate to be achieved in the banks of spray sources 230 232 and 234 once the valves 254, 256 and 258 are opened. The valves 254, 256 and 258 may be of a type that will open automatically when a sufficient pressure is achieved in the branch flow conduits 246, 248 and 250 and may close automatically when the pressure drops below a certain level. Additional check valves may be installed closer to the spray sources. Each individual spray source may have a dedicated check valve to keep water in the conduits closer to the spray sources, which spray sources may be individual nozzles. The valves 254, 256 and 258 may respond to different pressure levels from each other depending on the system requirements.

Although drains 224, 226 and 228 are shown, the number and position of the drains may be changed or omitted depending on the system requirements. As well the drains may not be connected to return conduits 265, and may drain to the environment, to a reservoir 241 or to other areas of the system to replenish water.

The sensors 270, 272, 274 and 276 are described are measuring the presence of the vehicle 208. Sensors may be positioned in more or different locations and may also measure different or other information such as velocity. For example, if one or more sensors is placed on the uphill section before the bank of spray sources 230, a measure of velocity may be used by the PLC 280 to calculate the time to activate, volume and pressure of water required by the bank of spray sources 230 to push the vehicle 208 over the first local peak 272. The PLC 280 could then operate the VFD 282 and the pump 240 according to the calculated requirements.

It will be appreciated that the fluid flow system 204 provides a means of reducing water requirements by supplying water to areas of the ride section 200 only when the water is needed, for example, when a vehicle is present. The fluid flow system 204 may be operated without a PLC 280 driven control system, for example, where the opening and closing of valves is controlled by timers based on measurement of the time it takes a vehicle to traverse a ride section 200. Alternatively, the valves may be directly controlled by proximity detectors that activate when the vehicle is adjacent a location.

In some embodiments, the pressure requirements for each of zones 271, 273 and 275 is a flow rate of 500-3000 gallons per minute (GPM) for each zone (1500-9000 GPM for the exemplary 3 zones) at a pressure of 20-60 PSI.

In some embodiments PLC 280 may record and store data that may be analysed and used, for example, to increase ride efficiency.

It will be appreciated that the fluid flow system 204 and the control system 206 may be used with completely different water ride features and may be used in any circumstance when it is desirable to turn water on only when necessary, for example, when a ride participate is present, or to provide cooling and maintain a temperature of the surface of a ride feature.

Figure 6:
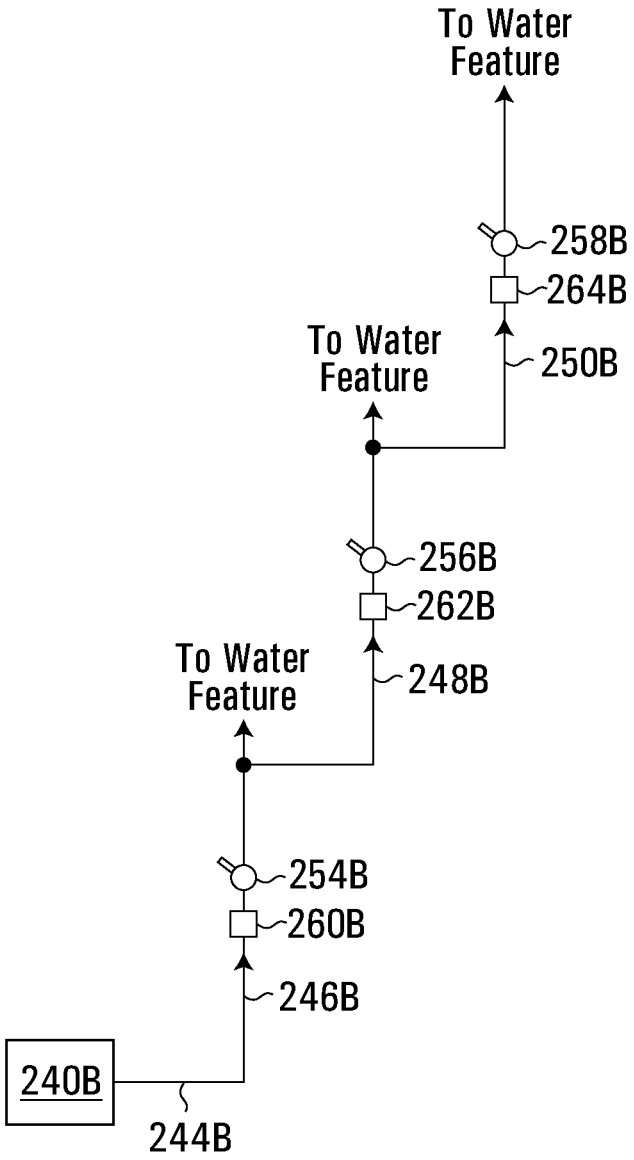
FIG. 6 is schematic view of a fluid system according to another embodiment of the invention.

The conduit structure of FIG. 5A shows a parallel system of conduits 246, 248 and 250. This structure may be replaced with a flow system 204B in which the conduits 244B, 246B, 248B and 250B are in series as shown in FIG. 6. The system includes flow valves 254B, 256B and 258B and check valves 260B, 262B and 264B. The flow system 204B of FIG. 6 may replace the flow system 204 of FIG. 5A. It will be noted that the return conduits are omitted from FIG. 6 but may form part of the flow system. In such a series configuration, fluid will flow to conduit 248 only when flow valve 254B is open and fluid will flow to conduit 250B only when both flow valves 254B and 256B are open. This is in contrast to the system of FIG. 5A when the closing of the flow valve 254 does not block the flow to the conduit 248 or 250.

Figure 7A:
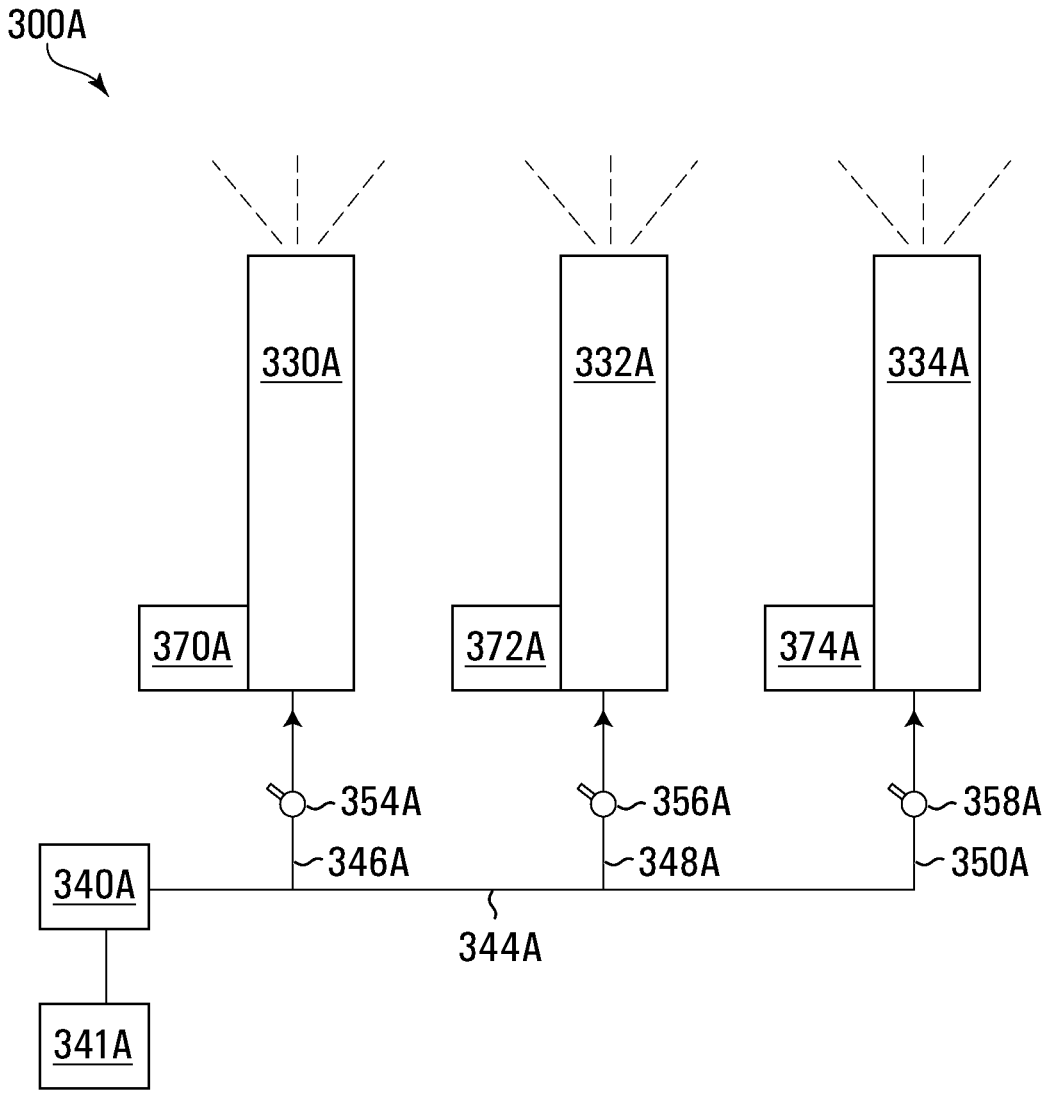
FIG. 7A is a schematic view of a water play structure according to another embodiment of the invention.

A fluid flow system, with or without the PLC control system may be used in other applications other than a water ride. FIG. 7A depicts a water play structure 300A. The water play structure 300A may include numerous fluid (e.g. water) features 330A, 332A and 334A such as sprinklers and water jets. Associated with each of the water features 330A, 332A and 334A are respective proximity detectors or other sensors 370A, 372A and 374A. To reduce the water consumption of the water play structure 300A, the water play structure 300A may include a fluid flow system 304A which includes a pump 340A, an outgoing flow conduit 244A; branch flow conduits 346A, 348A and 350A; and flow valves 354A, 356A and 358A in the branch flow conduits 346A, 348A and 350A.

In operation the pump 340A maintains pressure in the conduits 344A, 346A, 348A and 350A. The valves 354A, 356A and 358A are movable between open and closed positions and may also be maintainable at intermediate positions. The valves 354A, 356A and 358A are opened when a participant is detected adjacent the respective water feature 330A, 332A and 334A. The valves 354A, 356A and 358A are closed when no participant is detected adjacent the respective water features 330A, 332A and 334A. The opening and closing of the valves 354A, 355A and 358A may also be controlled by a control system, for example employing a PLC. The various embodiments and variations described in association with FIGS. 5A, 5B and 6 apply equally to the present embodiment.

Figure 7B:
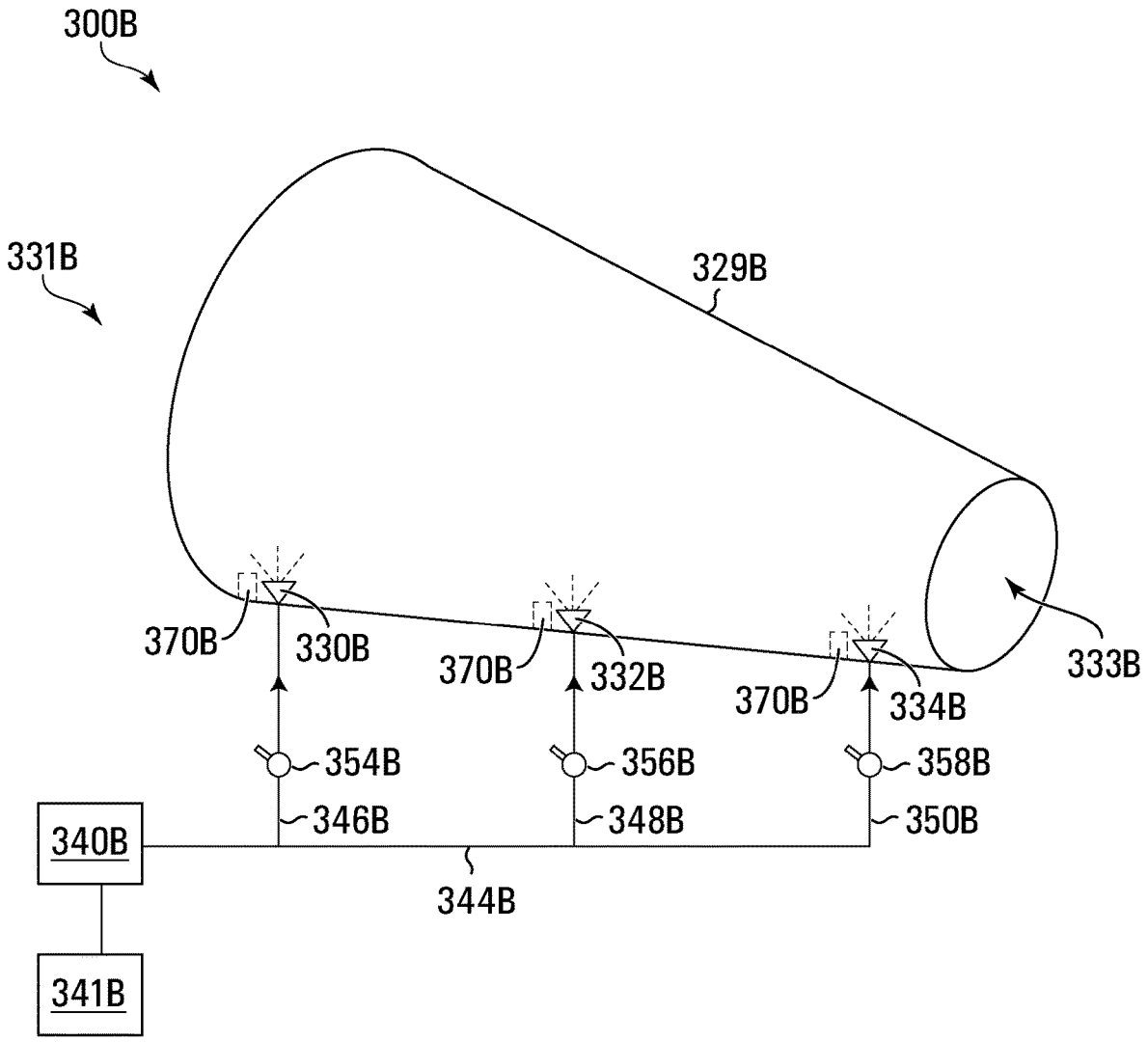
FIG. 7B is a schematic view of a water slide structure according to another embodiment of the invention.

FIG. 7B depicts a gravity based water slide structure 300B. The water slide structure 300B includes a sliding surface 329B having an entry end 331B and an exit end 333B. The water slide structure 300B may also include a number of water inputs 3308, 332B and 334B at various points along the slide path from the entry end 331B to the exit end 333B. Associated with each of the water inputs 330B, 332B and 334B are respective proximity detectors or other sensors 370B, 372B and 374B. To reduce the water consumption of the water slide structure 300B, the water play structure 300B may include a fluid flow system 304B which includes a pump 340B, an outgoing flow conduit 244B; branch flow conduits 346B, 348B and 350B; and flow valves 354B, 356B and 358B in the branch flow conduits 346B, 348B and 350B.

In operation the pump 340B maintains pressure in the conduits 344B, 346B, 348B and 350B. The valves 354B, 356B and 358B are opened when a participant is detected approaching the respective water inputs 330B, 332B and 334B. The valves 354B, 356B and 358B are closed after a specified amount of time has elapsed. The time may be set based on the rate at which a participant is expected to slide along the water slide. The opening and closing of the valves 354A, 355A and 358A may also be controlled by a control system, for example employing a PLC. The various embodiments and variations described in association with FIGS. 5A, 5B and 6 apply equally to the present embodiment.

Various pump types such as vertical turbine pumps, centrifugal pumps and submersible pumps may be used depending on the system requirements. The valves may be solenoid controlled valves or pneumatic or controlled by any automated means. The feedback signal from the valves may inform the control system, such as a PLC of the valve position, either discrete (open or closed) or analog (how much open or closed) where it is desired to retain the valve in an intermediate position.

In some embodiments, a single pump and controller can be used for one or multiple rides. In other embodiments, a single controller may control multiple pumps distributed around the ride to reduce the conduit length between the pumps and the water output location.

Figure 8A:
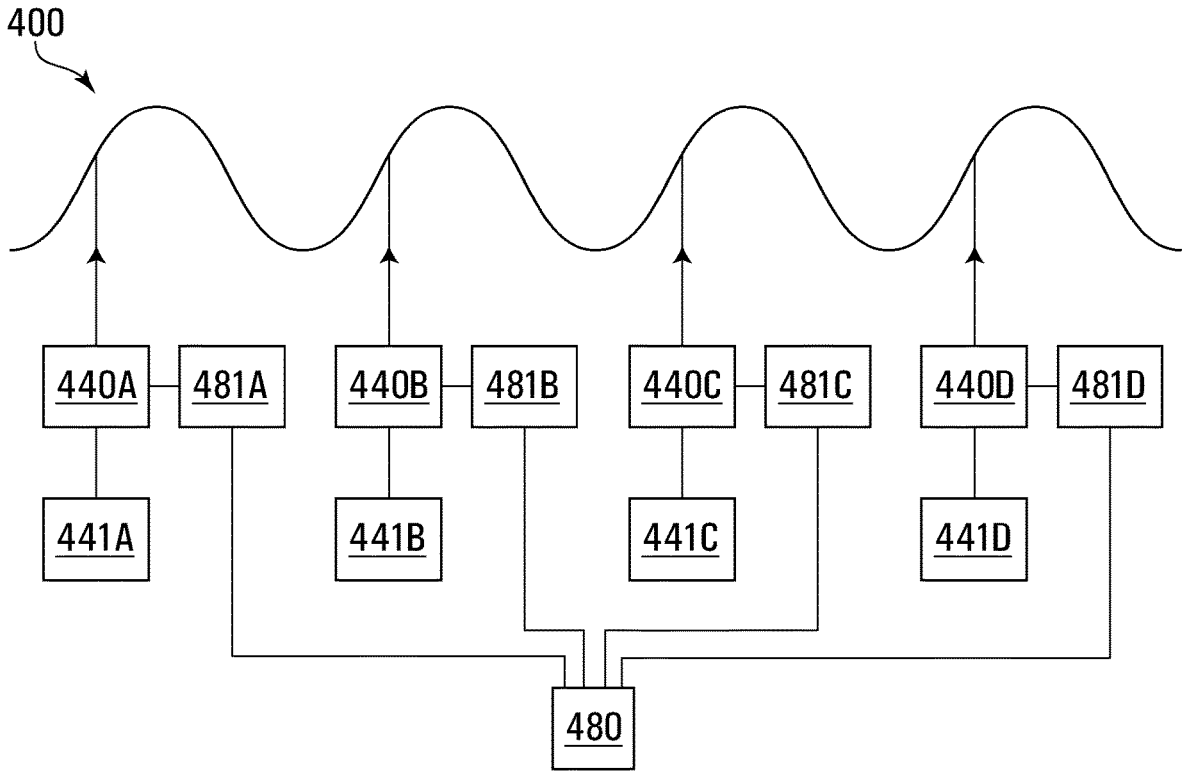
FIG. 8A is a schematic view of an amusement ride feature according to another embodiment of the invention.

In some embodiments, as shown in FIG. 8A, the control may also be partially or fully distributed. In particular, for the amusement ride feature 400, a single PLC 480 is used to control multiple VFDs 481A, 481B, 481C, 481D to drive multiple pumps 440A, 440B, 440C, 440D to take water from multiple reservoirs 441A, 441B, 441C, 441D to pump water to the amusement ride feature 400. In this embodiment the valves may be omitted. The pump speed of the pumps 440A, 440B, 440C and 440D is directly modulated by the PLC 480 without need to the valves.

Figure 8B:
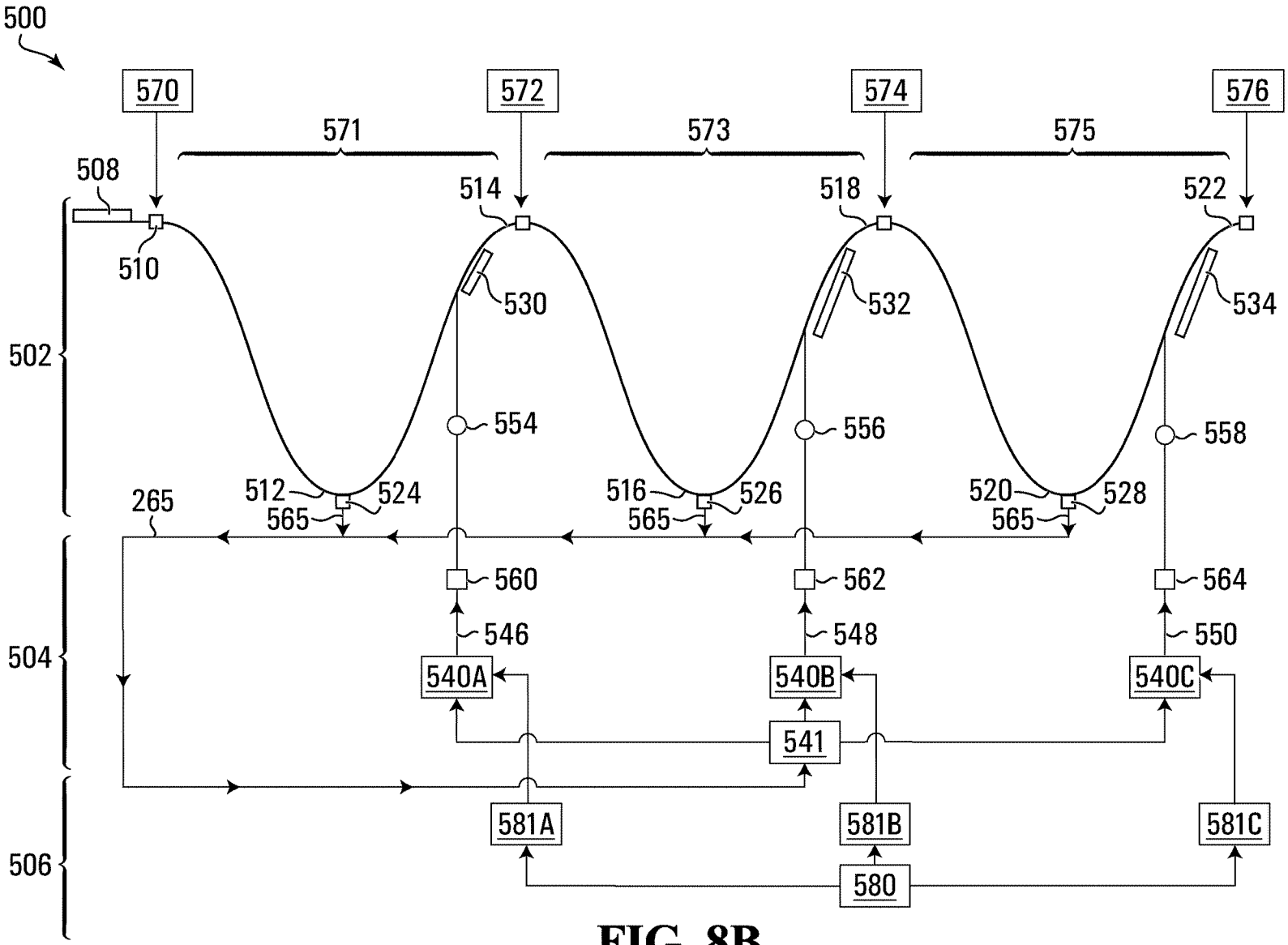
FIG. 8B is a schematic view of an amusement ride feature according to another embodiment of the invention.

As noted above, in some embodiments, the valves may be eliminated and flow control provided by a separate pairs of pumps and associated VFDs. FIG. 8B is a schematic view of a section of such an amusement ride 500. The section 500 includes a slide path 502, a fluid system 504, and a control system 506.

As described in respect to FIGS. 1 and 5A, the slide path may be defined by a channel such as a flume style slide having a central sliding surface between side walls. The sliding surface may be lubricated with water, as in a traditional flume ride, or may have a low friction coating. The channel may alternatively be a water filled channel in which there is sufficient fluid that a vehicle may float or the vehicle may include wheels and may roll or otherwise move. Walls may be closely adjacent the sliding surface to assist in guiding the vehicle along a predetermined path, or spaced further away from an indeterminate path of the vehicle.

In FIG. 8A, the slide path 502 is shown in profile. For example, a vehicle 508 starts from an elevated entry point 510. The slide path 502 is an undulating path with the path being downward from the entry point 510 to a first valley 512, upward to a first local peak 514, downward to a second valley 516, upward to a second local peak 518, downward to a third valley 520 and upward to a third local peak 522. It will be understood that the ride profile used is exemplary and numerous other ride profiles may be used including a purely planer, uphill or downhill profile.

In this embodiment, one or more of the first, second and third valleys 512, 516 and 520 may include first, second and third drains 524, 526 and 528, respectively, or other means for removing water which may accumulate at these relatively low areas of the slide path 502. Along the slide path between the first, second and third valleys 512, 516 and 520 and the respective first, second and third local peaks 514, 518 and 522 are one or more banks of spray sources 530, 532 and 534.

The banks of spray sources 530, 532 and 534 may be arranged in the same manner as the sprays sources 20A, 20B described in respect to FIG. 1. In particular, the banks of spray sources 520, 532 and 534 may consist of individual spray sources spaced along the walls of the slide path 502 and may include laterally aligned pairs along the opposite walls. In the present embodiment, the spray sources may be angled to direct water at an angle towards the direction of travel of the vehicle to apply a force to the vehicle to propel the vehicle along the slide path 502.

In this embodiment, the first, second and third banks of spray sources 530, 532 and 534 extend from an intermediate point along the incline between the first, second and third valleys 512, 516 and 520 and their respective first, second and third local peaks 514, 518 and 522 to approximately the respective first, second and third local peaks 514, 518 and 522. However, the number and position of each of the sprayers in the first, second and third banks of spray sources 230, 232 and 534 as well as the location of the first, second and third banks of spray sources 530, 532 and 534 will vary and will depend on the desired thrust force and duration needed, for example, to ensure that a vehicle travelling the slide path 502 has enough momentum to travel up and over each of the first, second and third local peaks 514, 518 and 522.

It will be appreciated that one or all of the first, second and third spray sources 530, 532 and 534 may be replaced with other ride features such as misters or water cannons, particularly for other ride profiles which may have different water requirements.

The first, second and third drains 524, 526 and 528 and the banks of spray sources 530, 532 and 534 provide an interface between the slide path 502 and the fluid system 504.

The fluid system 504 directs the water used by the amusement ride 500. The fluid system 504 includes first, second and third pumps 540A, 540B and 540C, a water source 541, and a series of conduits. The conduits include both first, second and third outgoing conduits 546, 548 and 550 from the pumps 540A, 540B and 540C to the banks of spray sources 530, 532 and 534, respectively, and return conduits 565 to return water to the water source 541. In some embodiments there may be more than one pump associated with each water feature. For example, if the bank of spray sources 534 were grouped into two sections (per the spray sources 20A and 20B in FIG. 3) a separate pump could be used for each section, or one pump could be used for both sections.

The first outgoing conduit 546 is in fluid communication with the water source 541 and the first pump 540A. Similarly, second outgoing conduit 548 is in fluid communication with the water source 541 and the second pump 540B and the third outgoing conduit 550 is in fluid communication with the water source 541 and the third pump 540C. Each of the first, second and third outgoing conduits 546, 548 and 550 connect the first, second and third pumps 540A, 540B and 540C, respectively to the first, second and third banks of spray sources 530, 532 and 534 respectively. It will be appreciated that there are numerous means by which fluid communication could be provided from the first, second and third pumps 540A, 540B and 540C to the first, second and third banks of spray sources 530, 532 and 534. As well, each of the first, second and third pumps 540A, 540B and 540C could be connected to separate water sources rather than a single water source 541.

The first, second and third branch outgoing conduits 546, 548 and 550 may also include first, second and third flow sensors 554, 556 and 558 and first, second and third check valves 560, 562 and 564, respectively. The flow sensors 546, 548 and 550 are located above the grade on each of the outgoing conduits 546, 548 and 550. In the present embodiment, the first, second and third check valves 560, 562 and 564 are between the first, second and third pumps 540A, 540B and 540C and the first, second and third flow sensors 554, 556 and 558.

In other embodiments, one or more check valves may instead be provided adjacent the water source 541 or adjacent the banks of spray sources 530, 532 and 534 respectively.

The first, second and third drains 524, 526 and 528 may connect to return conduits 565 which channel the drained water back to the pumps 540A, 540B and 540C or associated holding tank or reservoir 541.

Sensors may be provided along the slide path 502 to record and transmit information concerning the vehicle 508 traversing the slide path 502. In this embodiment, an entry sensor 570 is provided at the entry point 510 of the slide path 502. First, second and third feature sensors 572, 574 and 576 are provided at each of the first, second and third local peaks 514, 518 and 522 respectively. The section of the ride between the entry sensor 570 and the first feature sensor 572 is a first zone 571, the section of the ride between the first feature sensor 572 and the second feature sensor 574 is a second zone 573, and the section of the ride between the second feature sensor 574 and the third feature sensor 576 is a third zone 575. The entry, first, second and third feature sensors 570, 572, 574 and 576 may measure various parameters or characteristics of a participant or the vehicle 508. For example, in some embodiments, the entry, first, second and third feature sensors 570, 572, 574 and 576 may only measure the location or passage of the vehicle 508. In other embodiments, one or more of the entry, first, second and third feature sensors 570, 572, 574 and 576 may measure different and/or additional parameters such as velocity.

The entry, first, second and third feature sensors 570, 572, 574 and 576 form part of the control system 506. The control system 506 includes a controller, such as a programmable logic control (PLC) 580. In FIG. 8B, the PLC 580 is shown as connected to the first, second and third pumps 540A, 540B and 540C through a variable frequency drive (VFD) 581. For clarity, the electrical connection of the various elements of the control system is show in FIG. 8C. The flow sensors 546, 548 and 550 are also part of the control system 506.

Figure 8C:
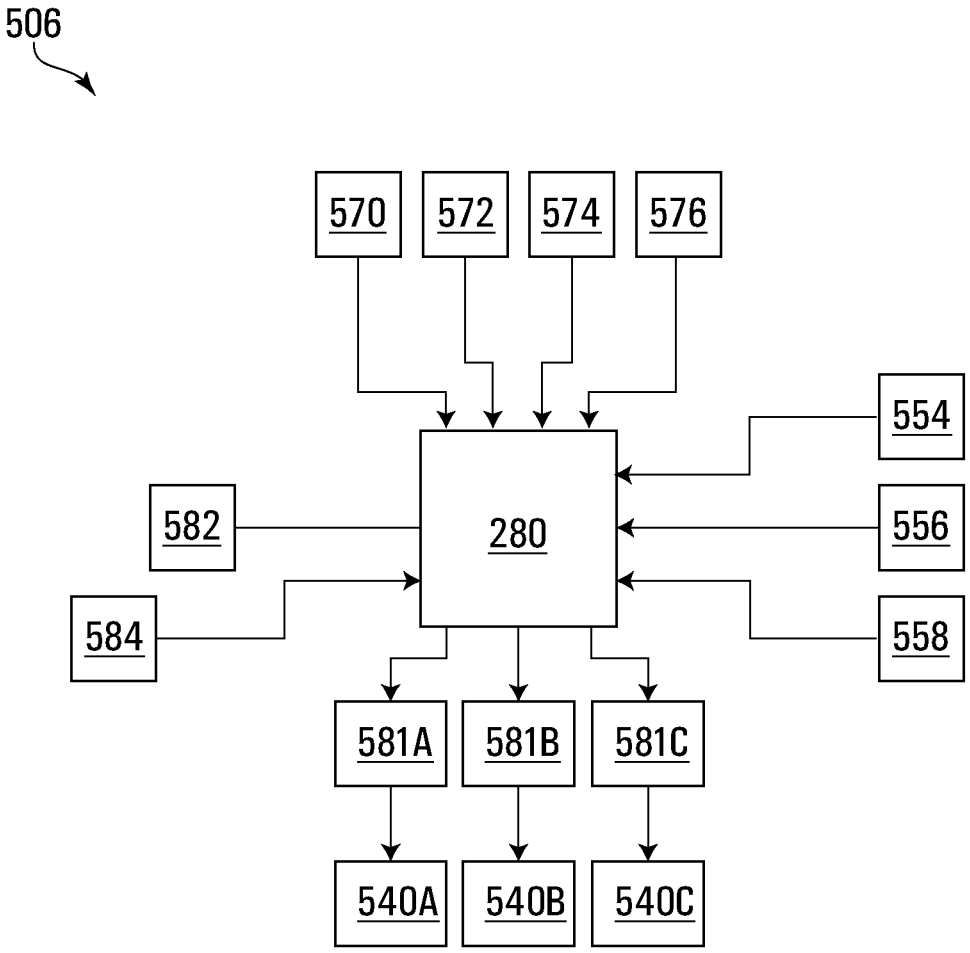
FIG. 8C is a schematic view of the control system of the embodiment of FIG. 8B.

As can be seen FIG. 8C, the entry, first, second and third feature sensors 570, 572, 574 and 576 are connected to the PLC 580. The first, second and third flow sensors 554, 556 and 558 are also connected to the PLC 580 and provide feedback/input to the PLC 580 to ensure that a threshold flow rate is achieved before the system is activated. The control system 506 may also include a user interface 584 and a storage device 582 connected to the PLC 580. In this embodiment, the PLC 580 is connected to the first, second and third pumps 540A, 540B and 540C through respective variable frequency drives (VFD) 581A, 581B and 581C. The VFDs 581A, 581B and 581C are used to modulate the operation of the pumps so that the pump output is at the required level. The connections of the PLC 580 to the other elements of the control system is shown schematically only. It will be appreciated that there are numerous connection structures possible including wireless connections.

The speed of the pumps 540A, 540B and 540C may be regulated for energy conservation during quiet times when a ride can go for many minutes without a rider. The pumps 540A, 540B and 540C may be turned down to some lower flow level, one which does not significantly affect the water balance of the entire mechanical system, but that which realises significant energy and noise reductions. When the system needs to return to normal operation again, it may be actuated by, for example, an operator push button, by sensors noting the presence or approach of a vehicle, or through the user interface 584. The system may register in some way to the operator whether it is safe or not to use e.g. a visual indicator such as a red/green traffic light system, a boom gate restricting access to the slide feature or a launch conveyor. When a gate or conveyor are used, the control system 506 will not allow a dispatch of a vehicle if it is not safe to do so.

In one exemplary mode of operation, the first, second and third pumps 540A, 540B and 540C are initially operated by the VFDs 581A, 581B and 581C at low frequency so that little or no water will flow through the first, second and third banks of spray sources 530, 532 and 534. The first, second and third check valves 560, 562 and 564 are oriented to allow water to flow from the pumps 540A, 540B and 540C in the outgoing flow direction to the first, second and third banks of spray sources 530, 532 and 534 but not in the reverse direction.

The vehicle 508 will slide past the entry sensor 570 on the water lubricated slide path 502. The entry sensor 570 will register the presence of the vehicle 508 and communicate this to the PLC 580. The PLC 580 will activate the first pump 540A through the VFD 581A. The VFD 581A will signal the first pump 540A to increase the pump speed to provide enough water to push the vehicle 508 up to the first local peak 514. The pump 540A will pump water through the first conduit 546 out through the first bank of spray sources 530. In the meantime, the vehicle 508 is continuing to slide down into the first valley 512 and then up toward the first local peak 514. As the vehicle 508 travels upward, the velocity of the vehicle 508 will slow. When the vehicle 508 moves past the first bank of spray sources 530, the bank of spray sources 530 will spray water against the vehicle 208 and provide force to help push the vehicle 508 up to the first local peak 514.

As the vehicle 508 travels over the first local peak 514, the vehicle 508 passes the first feature sensor 572. The first feature sensor 572 will register the presence of the vehicle 508 and communicate this to the PLC 580. The PLC 580 may increase the pump rate of the second pump 540B, for example, through the ramp up of the frequency of the power supplied to the second pump 540B by the VFD 581B to increase the water flow and pressure. The water pumped will travel through the second branch conduit 548. The water will be pumped out through the second bank of spray sources 532. In the meantime, the vehicle 508 is continuing to slide down into the second valley 516 and then up toward the second local peak 518. As the vehicle 508 travels upward, the velocity of the vehicle 508 will slow. When the vehicle 508 passes the second bank of spray sources 532, the spray sources 532 will spray water against the vehicle 508 and provide force to help push or boost the vehicle 508 up to the second local peak 518.

At the same time, since the vehicle 508 has passed the first bank of spray sources 530, the flow from these sources can be discontinued to reduce water requirements and energy consumption. To do so, the PLC 580 reduces the frequency of the first VFD 581A timing and rate of reduction of the frequency of the first VFD 581A may be immediately after the vehicle 208 passes the first local peak 514 or may be delayed or more gradual. For example, depending on the water pressure in the first branch conduit 546 and the rating of the first flow valve 554, the immediate closing of the first flow valve 554 under pressure may create too high a pressure in the first outgoing conduit 546. The PLC 580 may await a reduction in pressure in the first branch conduit 546, for example, from an adjustment of the first pump 540A output by the PLC 580 through the first VFD 581A. In some embodiments, the first flow sensor 554 in the first outgoing conduit 546 may provide feedback to the PLC 580 which the PLC 580 will us to appropriately ramp down the first VFD 581A.

In other embodiments, the operation of the VFDs may be controlled by a timer which is set based of flow calculations or measurements based on the size and length of the conduits, pump pressure and volume, and other know system variables used in designing a particular system. Where ride participants are introduced to the ride at predetermined intervals, for example, by the use of a belt conveyor or push button loading controlling participant dispatch rate, the timing of participants may be well know and used to control the operation of the VFDs. The VFDs could also be controlled by an operator.

In some embodiments the first pump 540A may not be completely stopped but may instead operate at a low rate to maintain a small flow of water pumping out through the first bank of spray sources 530, though not enough to boost the vehicle 508 over the first local peak 514. Even when the first pump 540A is not pumping, the first check valve 560 will prevent the water from draining back through the first check valve 560. Check valves may also be situated elsewhere in the fluid system 504 to help control water flow and retention in the fluid system 504. The system may also include one or more pressure relief valves to bleed off excessive pressure as required.

As the vehicle 508 travels over the second local peak 518, the vehicle 508 passes the second feature sensor 574. The second feature sensor 574 will register the presence of the vehicle 508 and communicate this to the PLC 580. The PLC 580 will increase or otherwise adjust the pump rate and pressure, of the third pump 540C, through the third VFD 581C. The water will be pumped through the third outgoing conduit 558 out through the third bank of spray sources 534. In the meantime, the vehicle 508 is continuing to slide down in to the third valley 528 and then up toward the third local peak 522. As the vehicle 508 travels upward, the velocity of the vehicle 508 will slow. When the vehicle 508 reaches the third bank of spray sources 534, the spray sources 534 will spray water against the vehicle 508 and provide force to help push the vehicle 508 up to the third local peak 522.

In a comparable manner to the first pump 540A, the second pump 540B will be partially or completely slowed by the second VFD 581B with the second check valve 562 operating in a comparable manner to the first check valve 560 to maintain water in the flow system 204.

As the vehicle 508 travels over the third local peak 522, the vehicle 508 passes the third sensor 576. The third sensor 576 will register the presence of the vehicle 508 and communicate this to the PLC 580. In a comparable manner to the first and second pumps 540A and 540B, the third pump 540C, will be partially or completely slowed with the third check valve 564 operating in a comparable manner to the first and second check valves 560 and 562 to maintain water in the flow system 504.

Throughout operation of the fluid and control systems 504 and 506, respectively, water which accumulates in the first, second and third valleys 512, 516, and 520 may drain through the first, second and third drains 524, 526 and 528 and return to the water source 541 through the return conduits 565.

It will be appreciated that the use of check valves 560, 562 and 564 may reduce the time for the required pressure and flow rate to be achieved in the banks of spray sources 530 532 and 534 once the valves 554, 556 and 558 are opened.

Additional check valves may be installed closer to the spray sources. Each individual spray source may have a dedicated check valve to keep water in the conduits closer to the spray sources, which spray sources may be individual nozzles.

In some embodiments the pressure requirements would be 40-55 PSI and the flow rate requirements would be 500-900 GPM.

Figure 8D:
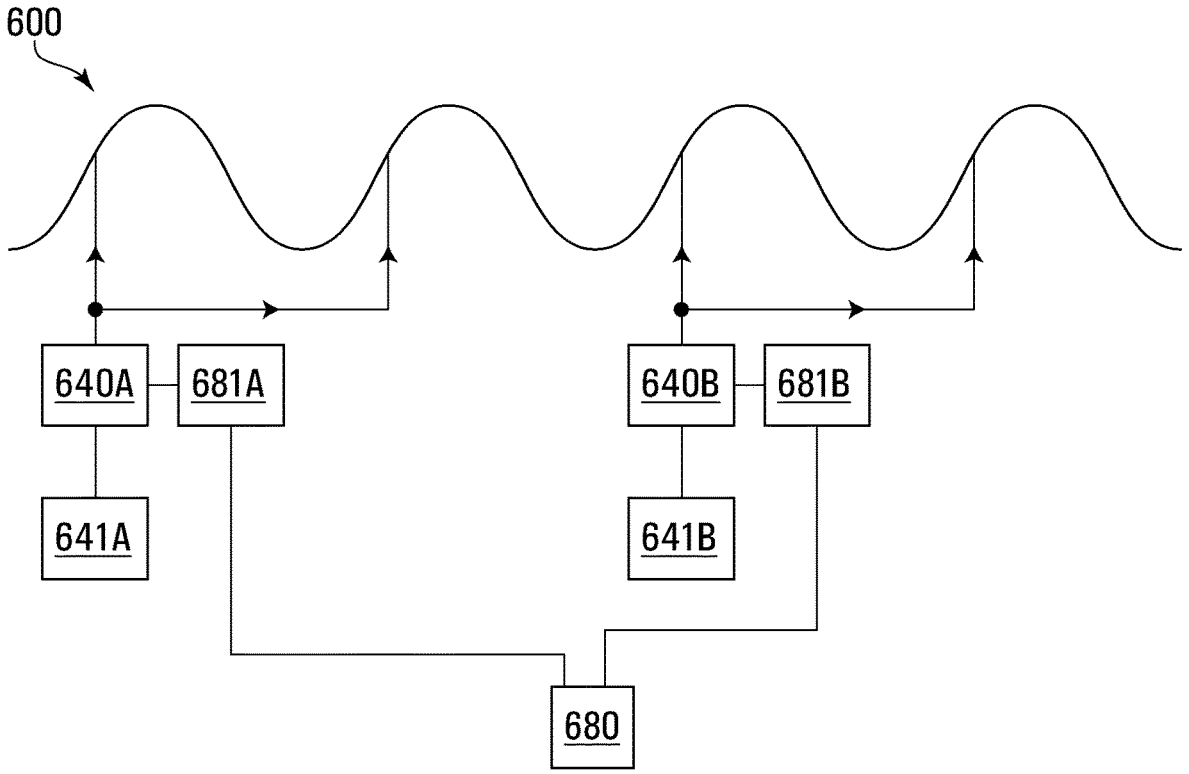
FIG. 8D is a schematic view of an amusement ride feature according to another embodiment of the design.

In some embodiments, as shown in FIG. 8D, distributed pumps may be used for multiple features. In particular, for the amusement ride feature 600, a single PLC 580 is used to control two DOLs 681A and 681B to drive two pumps 640A and 640B to take water from two reservoirs 641A and 641B to pump water to two features, such as uphill sections of the amusement ride feature 600. In this embodiment the valves may also be omitted. The pump speed of the pumps 640A and 640B is again directly modulated by the PLC 680 without need to the valves.

Figure 9:
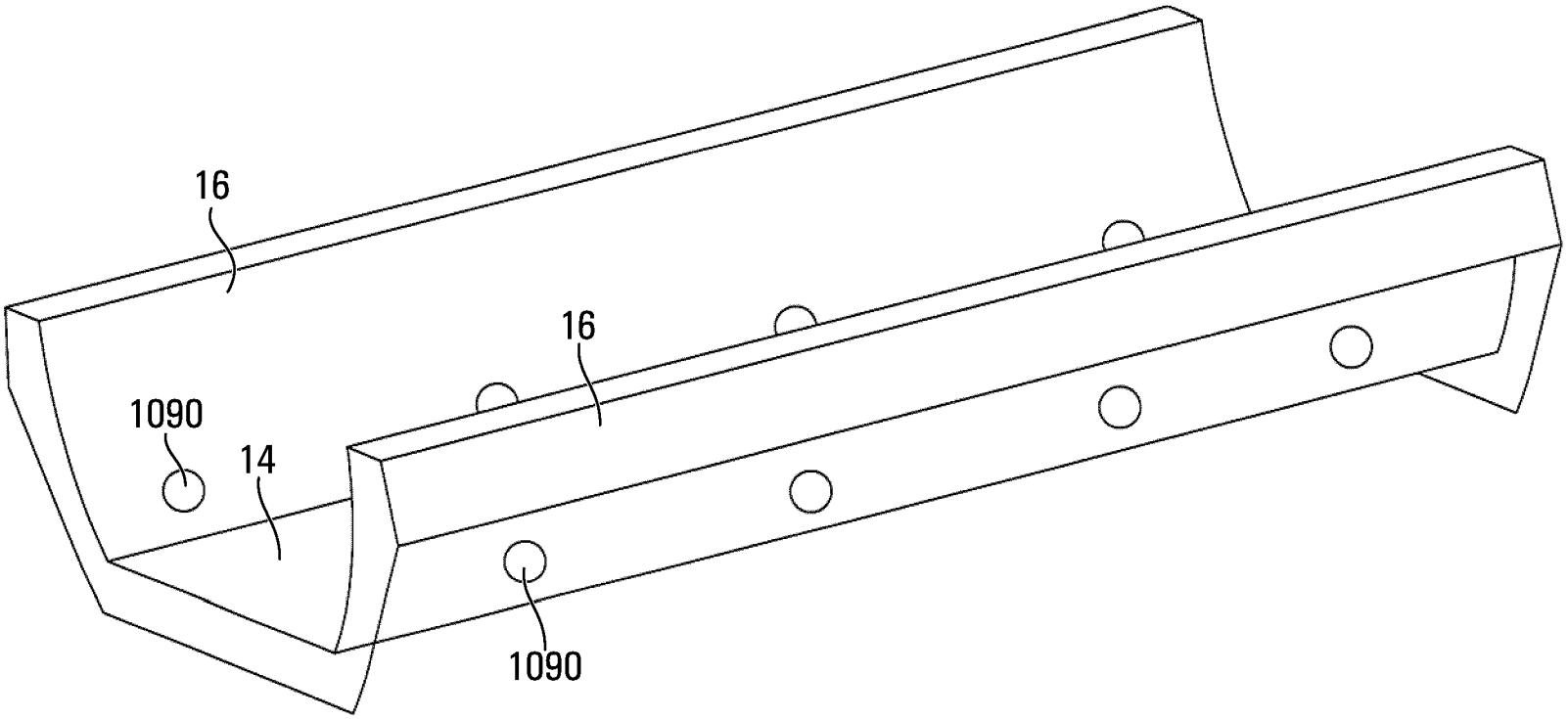
FIG. 9 is a perspective view of a section of an amusement ride channel according to the embodiment of FIG. 1.

FIG. 9 shows a perspective view of a section of the channel 12 of the amusement ride motion control system 10 of FIG. 1 or the section of an amusement ride 200 of FIG. 5A or the amusement ride 500 of FIG. 8B. The side walls 16 and the bottom 14 of the channel 12 are shown. Also shown are openings 1090. The openings 1090 are provided, for example, to allow positioning of the angle at which the water spray sources 20A, 20B (see FIG. 1) spray across the channel 12. The angle may be adjusted both along the channel and towards and away from the channel.

In some embodiments, rather than having recesses or intakes defined in the walls of the vehicle, there are protrusions from the vehicle body. The embodiment of FIGS. 10A to 10E depict top, side, bottom front and rear views, respectively, of the body of such a vehicle 1093. The vehicle 1093 of this embodiment is a modified raft type vehicle having a vehicle body with a front end 1092, a rear end 1094, sides

1096, and a bottom 1098. The vehicle 1093 has an inflated tube 1100 extending partly around the perimeter of the vehicle 1093 and defines the front end 1092 and sides 1096. The middle of the rear end 1094 is open. The bottom 1098 connects to the bottom surface of the inflated tube 30 (see FIG. 10E) to define an interior on the vehicle 1093 for carrying passengers. In this embodiment, the vehicle 1093 also includes two backrests 1102 allowing the vehicle 1093 to accommodate two riders.

In this embodiment the rear of the backrest 1102 is angled such that it acts as a deflector to deflect water impacting the rear of the backrest 1102 downward, away from the rider. In some embodiments, the deflector is provided separately and overhangs the rear of the boat to downwardly deflect water that contacts the back of the vehicle, away from the vehicle.

Figure 10A:
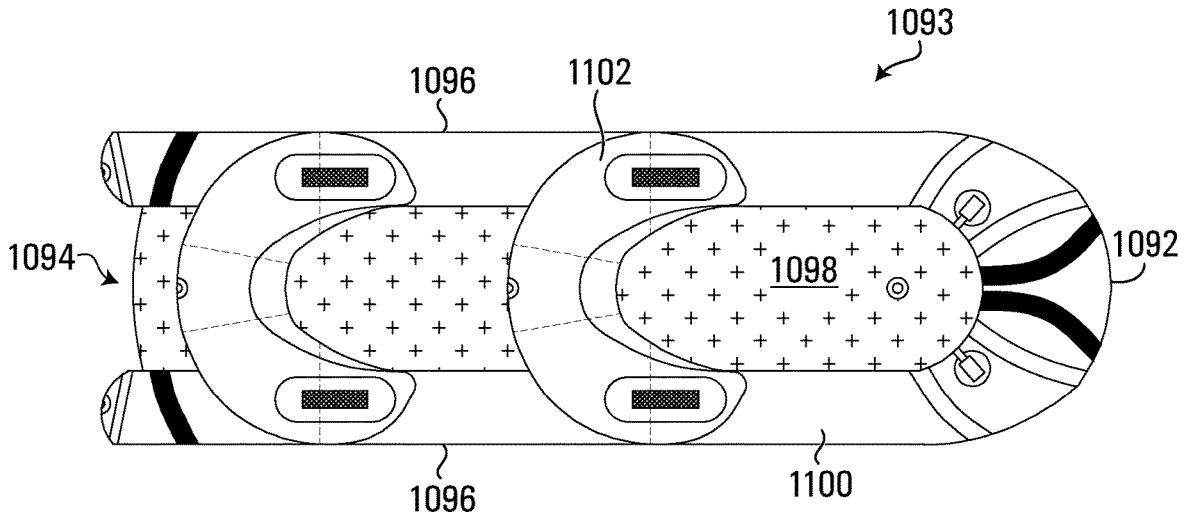
FIGS. 10A to 10E are top, side, bottom, front and rear views, respectively, of a vehicle according to another embodiment of the invention.
Figure 10B:
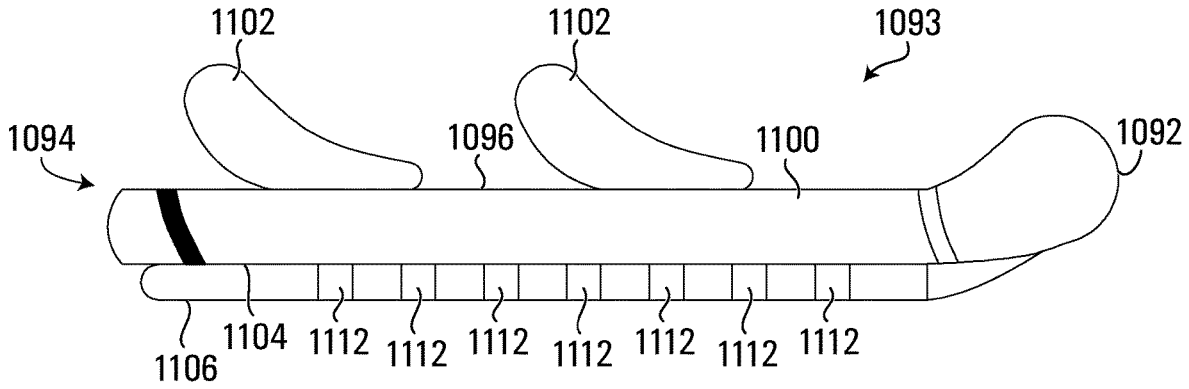
Figure 10C:
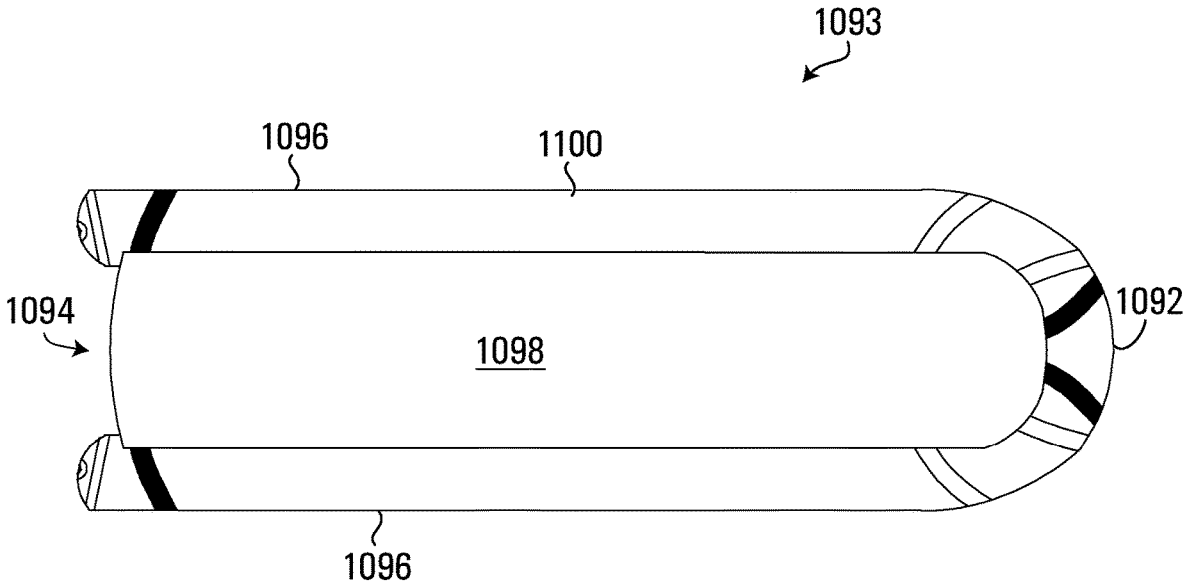
Figure 10D:
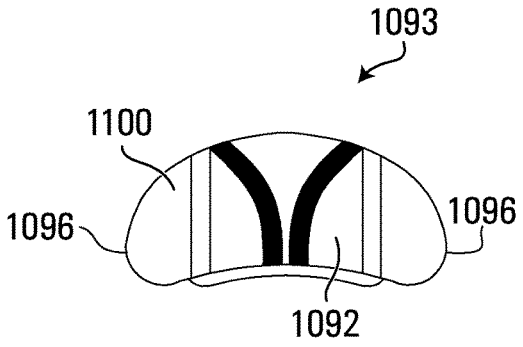
Figure 10E:
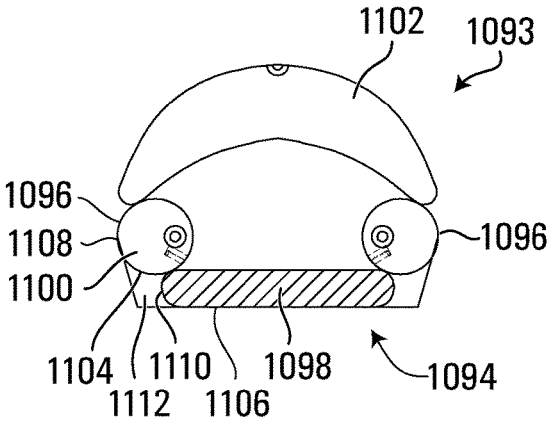
Figure 11A:
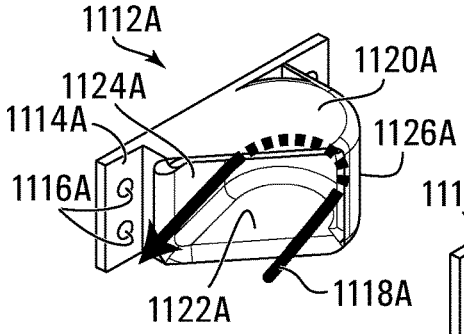
FIGS. 11A to 14C are perspective, top, side and operational views of three protrusion designs for use with the embodiment of FIGS. 10A to 10E.
Figure 11B:
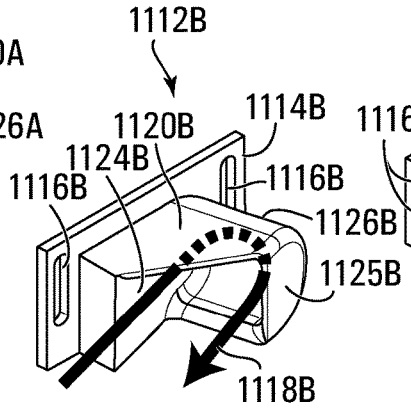
Figure 11C:
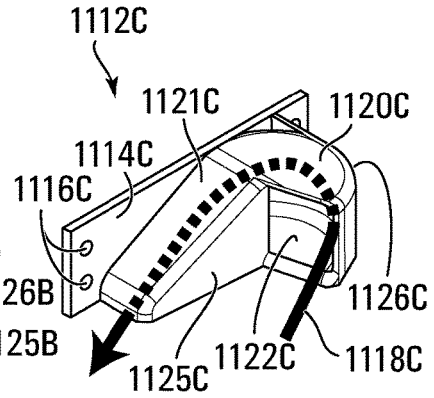
Figure 12A:
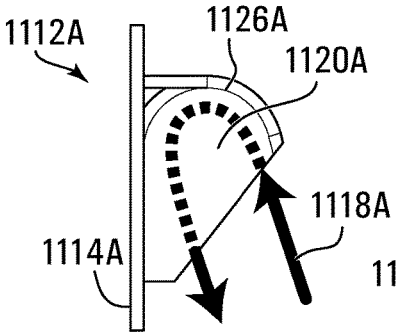
Figure 12B:
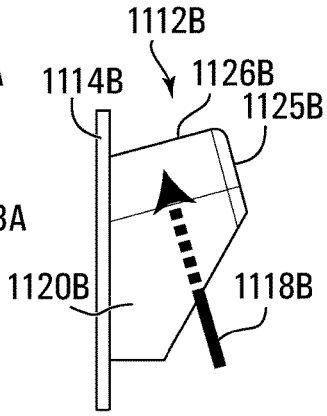
Figure 12C:
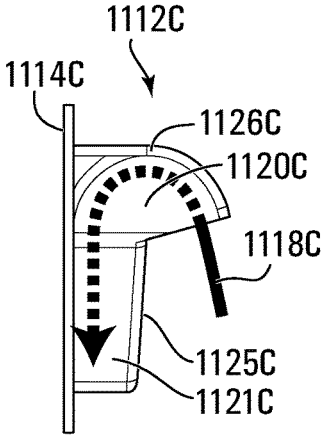
Figure 13A:
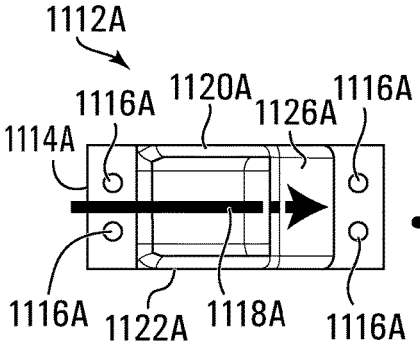
Figure 13B:
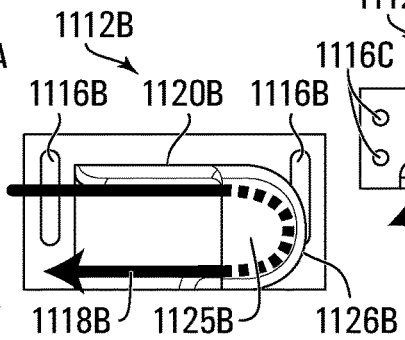
Figure 13C:
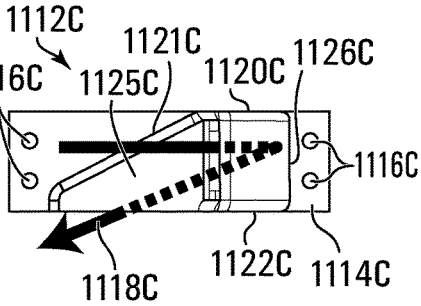

In this embodiment, as noted above, the sides 1096 are defined by the inflated tube 1100 connected to the bottom 1098. As best seen in FIGS. 10B and 10E, a bottom surface 1104 of the tube 1100 is above a bottom surface 1106 of the bottom 1098 of the vehicle 1093 and outside surfaces 1108 of the sides 1096 of the vehicle 1093 are outward beyond outside surfaces 1110 of the bottom 1098. This defines a two sided area in which protrusions 1112 may be located. A plurality of the protrusions 1112 may be spaced along the opposite sides 96 of the vehicle and angled to provide impact surfaces against which water from spray sources may impact to apply a force to the vehicle 1093. In this embodiment, the protrusions 1112 are beneath the inflated tube 1100 and adjacent the bottom 1098 but do not extend outward past the outer sidewalls of the sides 1096 or beneath the underside of the bottom surface 1104 of the vehicle. The protrusions may be flat, concave, convex or have an irregular impact surface. They may be angled to be perpendicular to the direction of the spray from the spray sources, or at lesser or greater angles. The angles, positioning and shape of the protrusions may differ from each other.

In some embodiments, the protrusions may be integrally formed with the vehicle 1093. In other embodiments, the protrusions 1112 may be separate components that may be attached to the vehicle 1093. In some embodiments, the protrusions may be removable and repositionable, both with respect to their number and their angle. The protrusions may also be beneath the bottom surface of the vehicle 1093.

The protrusions may be of different shapes beyond the irregular shape shown in FIGS. 10B and 10E. The protrusions may also extend outward beyond the outer surfaces 1108 of the vehicle 1093 or above the sides 1096 of the vehicle or any combination of such protrusions and the recesses discussed with respect to FIGS. 1 to 8D.

FIGS. 11A to 13C depict three different designs for protrusions 1112A, 1112B and 1112C which may be attached to vehicle 93. The protrusions 1112A, 1112B and 1112C each have respective back plates 1114A, 1114B and 1114C with openings 1116A, 1116B and 1116C defined there through. The openings 1116A, 1116B and 1116C may be used to fasten the protrusions 1112A, 1112B and 1112C to the vehicle using fasteners such as bolts. The protrusions 1112A, 1112B and 1112C may not have back plates 1114A, 1114B and 1114C and openings 1116A, 1116B and 1116C but may instead be fastened by other means such as an adhesive. Multiple protrusions may also be formed on a single back plate, rather than a single protrusion for each back plate.

The protrusion 1112A, 1112B and 1112C have differing shapes intended to direct water impacting against the protrusions 1112A, 1112B and 1112C in different directions. Arrows 1118A, 1118B and 1118C indicate how the water is directed by each of the protrusions 1112A, 1112B and 1112C. Mirror images of protrusions 1112A, 1112B and 1112C may be provided for the opposite side of the vehicle 1093.

The protrusion 1112A has a flat parallel spaced apart top 1120A and bottom 1122A. An inner wall 1124A extends beside the back plate 1114A and connects the top 1120A and the bottom 1122A. The inner wall 1124A is at an angle of approximately 15° to back plate 1114A. An end wall 1126A has a vertically oriented tubular shape extending between the top 1120A and the bottom 1122A. The top 1120A, the bottom 1122A, the inner wall 1124A and the end wall 1126A together define a water intake or cavity with an outwardly angled rectangular opening. A water jet sprayed into the cavity of the protrusion 1112A follows the path defined by arrow 1118A. In particular, the water travels a U-shaped horizontal path. The end wall 1126A functions as an impact surface. The water travels horizontally in and impacts against the end wall 1126A and is deflected to follow in a semicircle around the curvature of the end wall 1126A. The water exits horizontally along the inner wall 1124A in a path offset parallel to the path of the water when entering the protrusion 1112A.

The protrusion 1112B has a flat top 1120B with an open bottom and parallel inner and outer walls 1124B, 1125B. The inner wall 1124B extends beside the back plate 1114B and connects to the top 1120B. The inner wall 1124B is at an angle of approximately 15° to back plate 1114B. An end wall 1126B has a horizontally oriented tubular shape extending between the inner wall 1124B and the outer wall 1125B. The top 1120B, the inner wall 1124B, the outer wall 1125B and the end wall 1126B together define a water intake cavity with an outwardly angled rectangular opening and an open bottom. A water jet sprayed into the cavity of the protrusion 1112B follows the path defined by arrow 1118B. In particular, the water travels a U-shaped path. The end wall 1126B functions as an impact surface. The water travels horizontally in, impacts against the end wall 1126B and is deflected vertically downward along a U-shaped path to follow in a semicircle along the curvature of the end wall 1126B. The water exits along a path offset vertically below and parallel to the path of the water when entering the protrusion 1112B.

The protrusion 1112C has a wedge shaped part and an end part. The end part has a flat parallel spaced apart top 1120C and bottom 1122C. An end wall 1126C has a vertically oriented tubular shape extending between the top 1120C and the bottom 1122C. An inner side of the end wall 1126C connects to the back plate 1114C. Together the top 1120C, the bottom 1122C, and the end wall 1126C define a portion of a water intake cavity.

The wedge shaped part extends beside the back plate 1114C and has a triangular shaped outer wall 1125C parallel to the back plate 1114C and a downwardly angled top plate 1121C interconnecting the back plate 1114C and the outer wall 1125C. The wedge shaped part has an open bottom and defines a second portion of a water intake cavity. A rectangular end of the wedge shaped part connects to an inner half of the end part to define a vertical rectangular inlet opening to the intake cavity and a rectangular horizontal outlet opening from the intake cavity. A water jet sprayed into the cavity of the protrusion 1112C follows the path defined by arrow 1118C. The end wall 1126C functions as an impact surface. The water travels horizontally in and impacts against the end wall 1126C and is deflected to follow in a semicircle around the curvature of the end wall 1126C. The water is then directed to angle downward by the wedge shape part and exits angled downwardly in along the back plate 1114C.

Figure 14A:
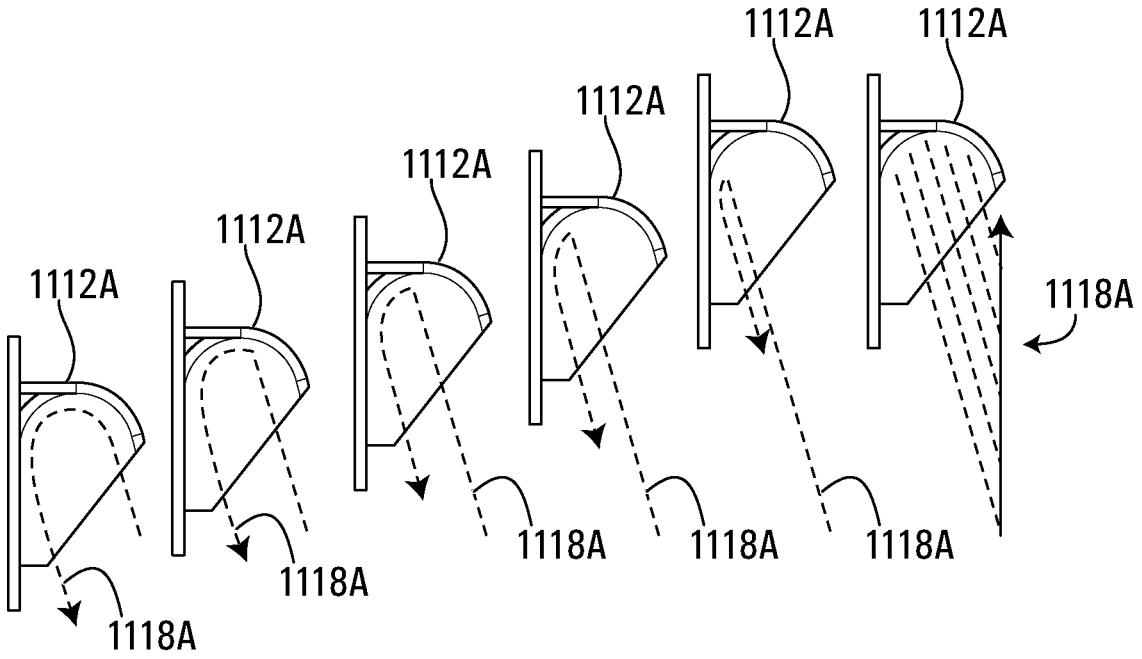
Figure 14B:
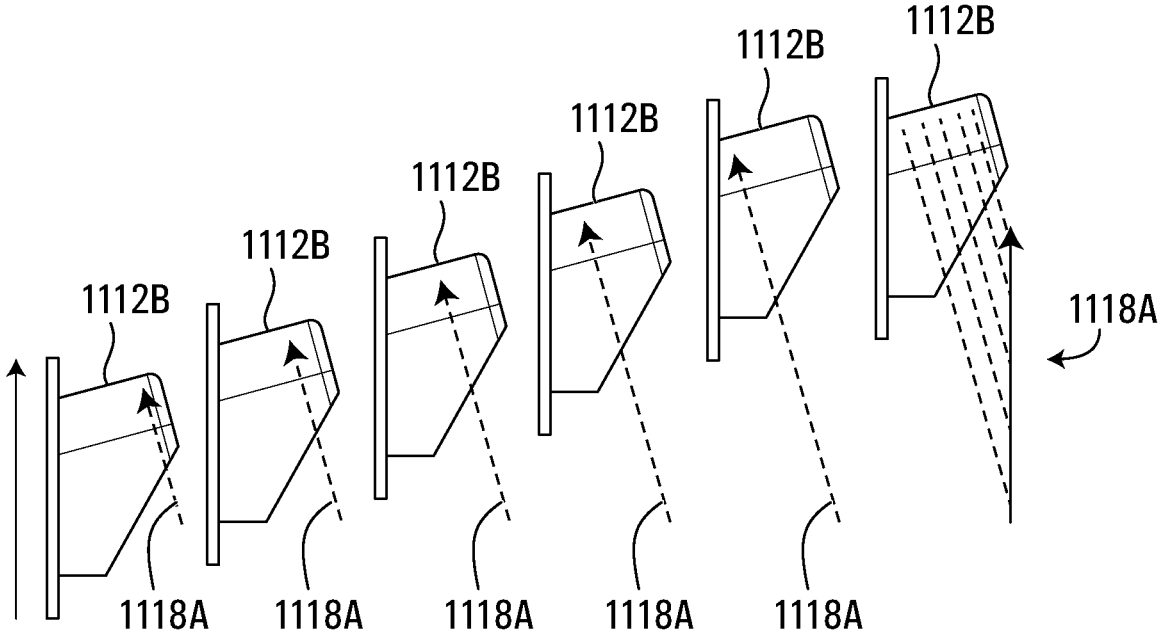
Figure 14C:
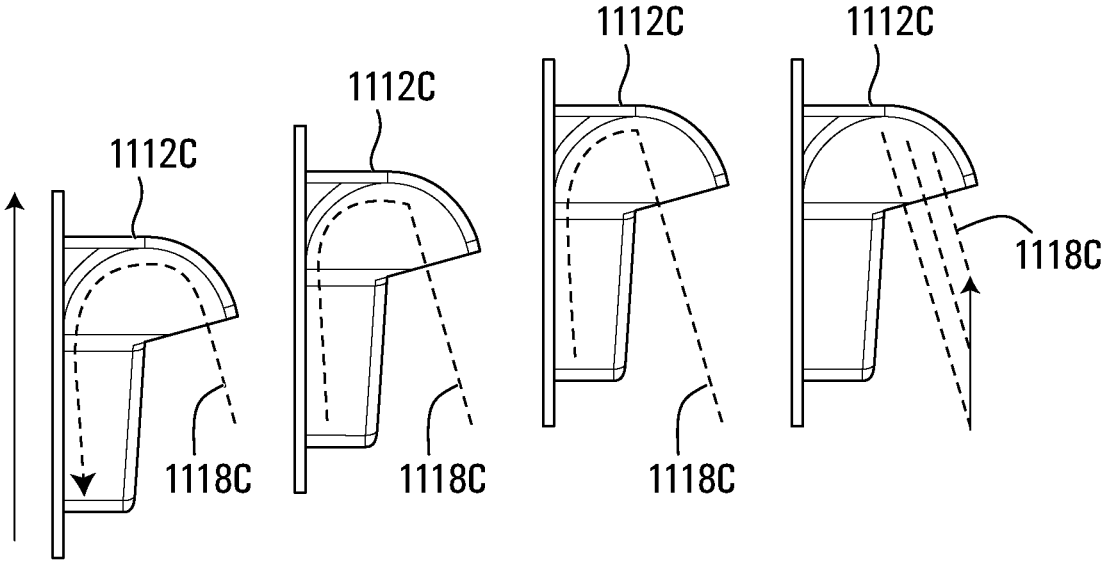

The impact of the water jet against the impact surfaces of the protrusions 1112A, 1112B and 1112C applies a force to the vehicle 1093 to propel the vehicle forward. FIGS. 14A, 14B and 14C illustrate how the path of a water jet 1118A, 1118B and 1118C changes as the vehicle 1093 moves forward away from the source of the water jet 1118A, 1118B and 1118C.

The protrusions 1112A, 1112B and 1112C are exemplary protrusions. In this embodiment, the protrusions 1112A and 1112B have height×length×width dimensions of 2.5"×6"×3" and the protrusions 1112C have height×length×width dimensions of 2.5"×8"×4" for a 4" intake. It will be appreciated that numerous other shapes and dimensions of protrusions and recesses, with or without an intake cavity, can be formed which define an impact surface to receive a force applied by a jet of water to cause movement of the vehicle 1093. The protrusions and recesses can be sized positioned and provided in such numbers as required to impart, in combination with the jet spray, the desired force to the vehicle.

In some embodiments the recesses and protrusions and the spray sources may be oppositely oriented, such that the forces applied by the spray sources on the vehicle will act against the direction of travel of the vehicle, for example to decelerate the vehicle. In other embodiments, for example, a circular vehicle with recesses around the perimeter in the same orientation, the spray sources may be on only one side. The forces applied by the spray sources on the vehicle may cause the vehicle to rotate. In some embodiments, the recesses and protrusions may be asymmetrical to cause uneven force to be applied to different areas of the vehicle, such as along the sides or on opposite sides.

The vehicle 208 and the vehicle 508 may, for example, be the vehicle type as described with respect to FIGS. 1 to 4C and 10A to 14C. However, it will be appreciated that other vehicles may be used and the control systems described in respect of FIGS. 1 to 8D may be used with various types of vehicles, or without vehicles, depending on the requirements of the ride or play structure.

Figure 15:
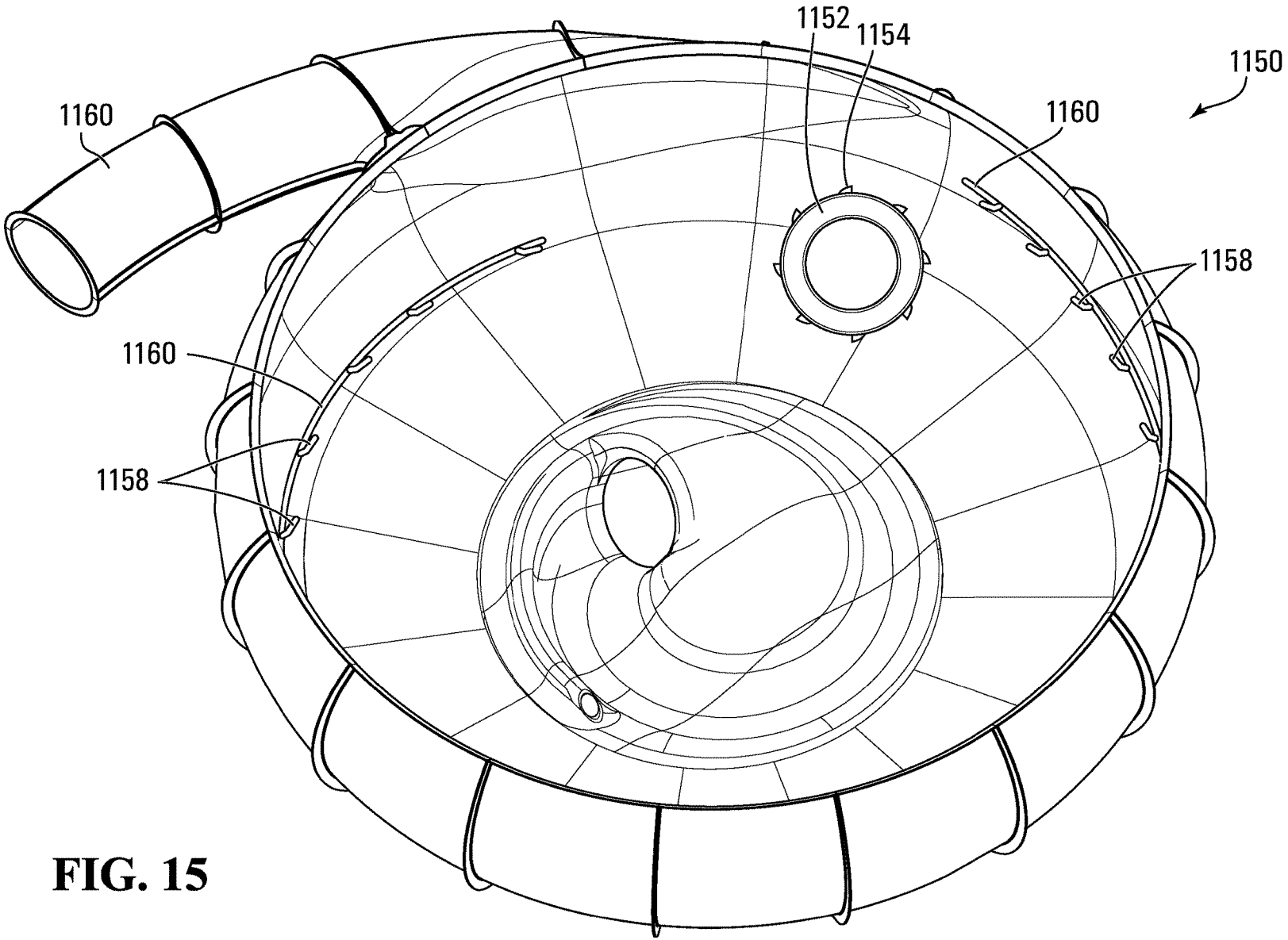
FIG. 15 is a schematic view of a waterslide according to another embodiment of the invention.

In other embodiments, the invention is used in association with other types of amusement rides such as a funnel ride as described in U.S. Pat. No. 6,857,964 and bowl-style rides as shown in U.S. Design Pat. No. D521,098, each of which are incorporated herein by reference in its entirety. FIG. 15 illustrates a circular vehicle 1152 sliding on such a bowl-style ride feature 1150. Vehicle 1152 has a plurality of water intake protrusions 1154 around its perimeter. A plurality of water jet spray sources 1158 are connected through a water inlet pipe 1156 which may be mounted on the surface of or below the surface of the ride feature 1150 with the water jet spray sources 1158 protruding through the surface of the ride feature 1150. The ride feature 1150 has an inlet 1160 through which the circular vehicle 1152 enters the ride feature 1150. It will be appreciated that water jets sprayed from the spray sources 1158 can impact against the water intake protrusions 1154 and impart a spinning force or, depending on the relative orientation of the water jets and the protrusions and/or recesses, another force to slow down, speed up or otherwise affect movement of the vehicle 1152.

In some embodiments, the fluid impact surfaces are beneath the surface of the water in the channel and the jets pump a stream of water through the water in the channel to impact against the fluid impact surfaces.

Numerous modifications and variations of the present invention are possible in light of the above teachings. It is therefore to be understood that within the scope of the appended claims, the invention may be practised otherwise than as specifically described herein.

The invention claimed is:

1. An amusement ride vehicle motion control system comprising:

an upwardly extending channel;

a bank of fluid spray sources positioned to spray fluid over the upwardly extending channel to concurrently exert force on opposite sides of a vehicle to boost the vehicle up the upwardly extending channel wherein the channel comprises side walls and the bank of fluid spray sources are positioned along each of the side walls and extend through openings in opposite side walls of the channel, the openings extending completely through the opposite side walls of the channel from an outside to an inside of the side walls;

at least one first sensor adapted to detect when the amusement ride vehicle enters a zone of the upwardly extending channel;

at least one pump associated with the bank of fluid spray sources; and a controller adapted to increase the fluid flow by the at least one pump to the respective fluid spray sources in response to an amusement ride vehicle entering the zone.

2. The amusement ride vehicle motion control system of claim 1 further comprising at least one second sensor adapted to detect when the amusement ride vehicle leaves the zone of the upwardly extending channel, the controller being adapted to reduce the pump output to decrease the flow from the fluid spray source in response to the amusement ride vehicle exiting the zone.

3. The amusement ride vehicle motion control system of claim 2 further comprising:

a second plurality of fluid spray sources positioned to spray fluid over the upwardly extending channel;

at least one third sensor adapted to detect when the amusement ride vehicle enters a second zone of the upwardly extending channel;

at least one second pump associated with the second plurality of fluid spray sources; and the controller being adapted to increase the fluid flow by the at least one second pump to the respective second plurality of fluid spray sources in response to an amusement ride vehicle entering the zone.

4. The amusement ride vehicle motion control system of claim 1, wherein the respective pumps are connected to the controller by a variable frequency drive, wherein the respective variable frequency drives are adapted to control the rate of the respective pumps.

5. The amusement ride vehicle motion control system of claim 1 wherein the upwardly extending channel comprises a sliding surface and the vehicle is adapted to slide on the sliding surface.

6. The amusement ride vehicle motion control system of claim 1 further comprising:

a check valve between the at least one pump and the bank of fluid spray sources; and a flow valve between the check valve and the bank of fluid spray sources.

7. The amusement ride vehicle motion control system of claim 1 wherein the bank of fluid spray sources are positioned to also concurrently spray water at the back of the vehicle to assist in boosting the vehicle up the upwardly extending channel.

8. A method of affecting the motion of a vehicle in a sliding on a waterslide comprising:

providing an upwardly extending channel in the waterslide, the channel comprising side walls and openings in opposite side walls of the channel, the openings extending completely through the opposite side walls of the channel from an outside to an inside of the side walls;

positioning a bank of water spray sources along each of the side walls and extending through the openings in the opposite side walls of the channel and to spray water at a vehicle in the upwardly extending channel to concurrently exert force on opposite sides of the vehicle to boost the vehicle up the upwardly extending channel;

sensing when the vehicle enters the upwardly extending channel; and increasing a rate of a pump to spray water from the water spray sources at a pressure and flowrate to affect motion of the vehicle.

9. The method of claim 8 further comprising sensing when the vehicle is exiting the upwardly extending channel; and decreasing the rate of the pump to reduce the spray water from the water spray sources.

10. The method of claim 8 further comprising operating a variable frequency drive to control the rate of the pump.

11. The method of claim 8 further comprising:

operating a check valve between the pump and the bank of fluid spray sources; and operating a flow valve between the check valve and the bank of fluid spray sources.

12. The method of claim 8 wherein the bank of water spray sources are positioned to also concurrently spray water at the back of the vehicle to assist in boosting the vehicle up the upwardly extending channel.

13. An amusement ride vehicle motion control system comprising:

an upwardly extending channel;

a bank of fluid spray sources positioned to spray fluid over the upwardly extending channel to exert force on a vehicle to boost the vehicle up the upwardly extending channel wherein the channel comprises side walls and the bank of fluid spray sources are positioned along each of the side walls;

at least one first sensor adapted to detect when the amusement ride vehicle enters a zone of the upwardly extending channel;

at least one pump associated with the bank of fluid spray sources;

a controller adapted to increase the fluid flow by the at least one pump to the respective fluid spray sources in response to an amusement ride vehicle entering the zone;

a check valve between the at least one pump and the bank of fluid spray sources; and a flow valve between the check valve and the bank of fluid spray sources.

14. A method of affecting the motion of a vehicle in a sliding on a waterslide comprising:

providing an upwardly extending channel in the waterslide, the channel comprising side walls;

positioning a bank of water spray sources along each of the side walls to spray water at a vehicle in the upwardly extending channel to exert force on the vehicle to boost the vehicle up the upwardly extending channel;

sensing when the vehicle enters the upwardly extending channel;

increasing a rate of a pump to spray water from the water spray sources at a pressure and flowrate to affect motion of the vehicle;

operating a check valve between the pump and the bank of fluid spray sources; and operating a flow valve between the check valve and the bank of fluid spray sources.

* * * * *